US010030849B2

(12) United States Patent
Im et al.

(10) Patent No.: US 10,030,849 B2
(45) Date of Patent: Jul. 24, 2018

(54) LIGHTING APPARATUS

(71) Applicant: LG INNOTEK CO., LTD., Seoul (KR)

(72) Inventors: Chang Hyuk Im, Seoul (KR); Ki Hyun Kim, Seoul (KR); Ki Bum Kim, Seoul (KR); Bu Kwan Je, Seoul (KR); Sung Do Kim, Seoul (KR); Jin Wook Kim, Seoul (KR); Yeo Jun Yun, Seoul (KR); Ji Hwan Jeon, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 0 days.

(21) Appl. No.: 15/297,703

(22) Filed: Oct. 19, 2016

(65) Prior Publication Data

US 2017/0108195 A1 Apr. 20, 2017

(30) Foreign Application Priority Data

| | | |
|---|---|---|
| Oct. 19, 2015 | (KR) | 10-2015-0145586 |
| May 2, 2016 | (KR) | 10-2016-0053964 |
| May 2, 2016 | (KR) | 10-2016-0053966 |
| May 2, 2016 | (KR) | 10-2016-0053973 |

(51) Int. Cl.
*F21V 7/09* (2006.01)
*F21V 3/04* (2018.01)
(Continued)

(52) U.S. Cl.
CPC ..... *F21V 7/09* (2013.01); *F21S 8/04* (2013.01); *F21V 3/0625* (2018.02); *F21V 7/0008* (2013.01); *F21V 7/0025* (2013.01); *F21V 7/0058* (2013.01); *F21V 23/001* (2013.01); *F21V 23/02* (2013.01); *F21V 23/06* (2013.01); *F21V 13/02* (2013.01); *F21Y 2103/33* (2016.08);
(Continued)

(58) Field of Classification Search
CPC ..... F21V 7/09; F21V 23/06; F21V 3/0445; F21V 7/0025; F21V 7/0008; F21V 7/0058; F21V 23/001; F21V 23/02; F21V 13/02; F21S 8/04; F21Y 2113/13; F21Y 2115/10; F21Y 2103/33; F21Y 2105/18
See application file for complete search history.

(56) References Cited

U.S. PATENT DOCUMENTS

| | | | |
|---|---|---|---|
| 2005/0002190 | A1 | 1/2005 | Kramer et al. |
| 2010/0321919 | A1 | 12/2010 | Yang |
| 2012/0081903 | A1 | 4/2012 | Leung et al. |

FOREIGN PATENT DOCUMENTS

| | | |
|---|---|---|
| EP | 0 416 253 | 3/1991 |
| EP | 1 353 123 | 10/2003 |
| WO | WO 2008/146229 | 12/2008 |

OTHER PUBLICATIONS

European Search Report dated Dec. 15, 2016 issued in Application No. 16193986.3.

*Primary Examiner* — Tracie Y Green
(74) *Attorney, Agent, or Firm* — KED & Associates, LLP

(57) ABSTRACT

A lighting apparatus includes a first body including a first inner circumferential surface and a first outer circumferential surface, a cover disposed on and fastened to the first body and including an open bottom surface, an optical member disposed between the first body and the cover and exposed at the open bottom surface of the cover, and a light source member including a circuit board disposed between the cover and the optical member along an edge of the cover and at least two light sources mounted on the circuit board to face each other.

20 Claims, 29 Drawing Sheets

(51) Int. Cl.

| | |
|---|---|
| ***F21V 23/02*** | (2006.01) |
| ***F21S 8/04*** | (2006.01) |
| ***F21V 7/00*** | (2006.01) |
| ***F21V 23/00*** | (2015.01) |
| ***F21V 23/06*** | (2006.01) |
| ***F21V 3/06*** | (2018.01) |
| *F21V 13/02* | (2006.01) |
| *F21Y 115/10* | (2016.01) |
| *F21Y 103/33* | (2016.01) |
| *F21Y 113/13* | (2016.01) |
| *F21Y 105/18* | (2016.01) |

(52) U.S. Cl.
CPC ..... *F21Y 2105/18* (2016.08); *F21Y 2113/13* (2016.08); *F21Y 2115/10* (2016.08)

LIGHTING APPARATUS

CROSS-REFERENCE TO RELATED APPLICATION

This application claims priority to and the benefit of Korean Patent Application Nos. 10-2015-0145586, filed on Oct. 19, 2015, 10-2016-0053964, filed on May 2, 2016, 10-2016-0053966, filed on May 2, 2016, and 10-2016-0053973, filed on May 2, 2016, whose entire disclosure is incorporated herein by reference.

BACKGROUND

1. Field

The present disclosure relates to a lighting apparatus.

2. Background

Light emitting diodes (LEDs) are kinds of semiconductor devices which convert electric energy into light. LEDs may have advantages such as low power consumption, a semi-permanent life, high response speed, safety, and environmental friendliness compared with existing light sources such as fluorescent lamps, incandescent lamps, etc. Accordingly, more research for replacing existing light sources with LEDs has been performed.

LEDs are becoming more commonly used as light sources of lighting apparatuses indoors and outdoors such as various types of liquid crystal displays, light boards, streetlamps, etc. Lighting apparatuses using LEDs as light sources may include light source members including a printed circuit board (PCB) on which an LED may be mounted.

In a general lighting apparatus, a part of a body may overlap an optical member to fix an edge of the optical member. In this case, a protruding portion of the body may block out a portion of light generated by a light source and a band-shaped shadow may be generated at an edge of a light emission surface of the optical member.

BRIEF DESCRIPTION OF THE DRAWINGS

The embodiments will be described in detail with reference to the following drawings in which like reference numerals refer to like elements wherein.

DETAILED DESCRIPTION

Figure 1:
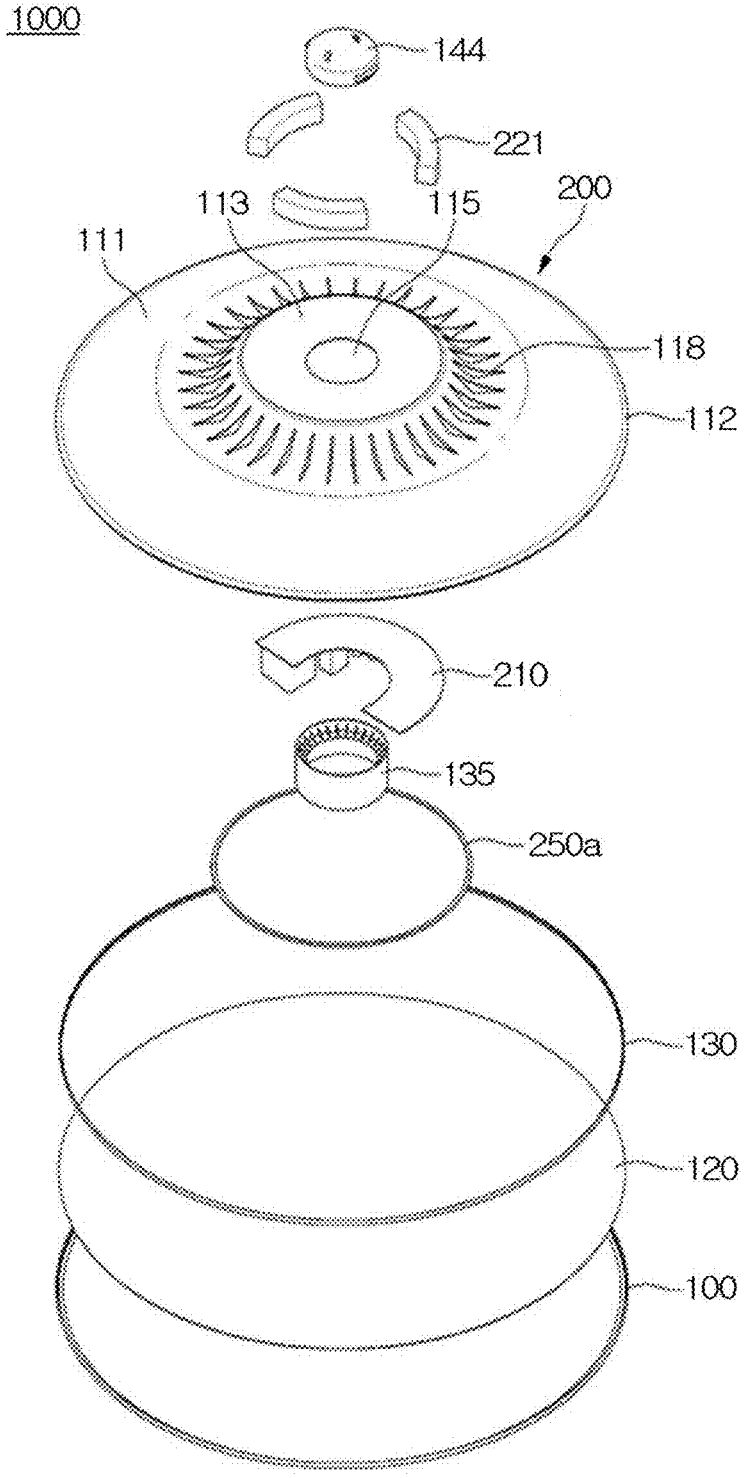
FIG. 1 is an exploded perspective view of a lighting apparatus according to an embodiment of the present disclosure.
Figure 2:
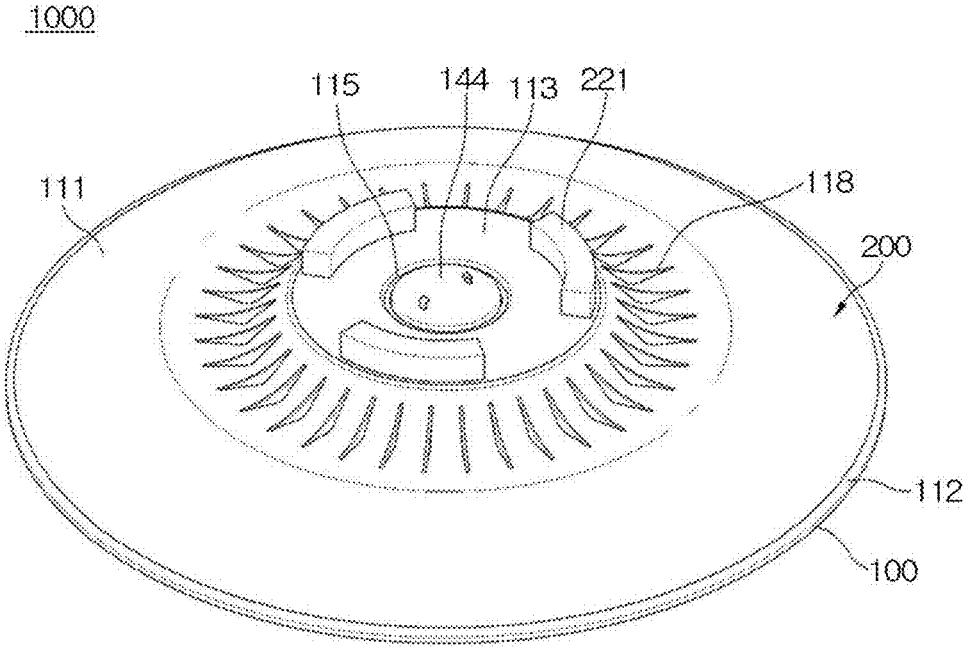
FIG. 2 is a combined perspective view of the lighting apparatus of FIG. 1.
Figure 3:
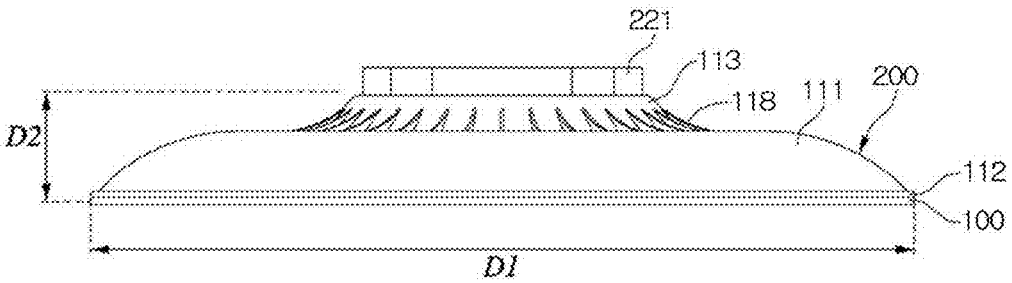
FIG. 3 is a combined side view of the lighting apparatus of FIG. 1.
Figure 4:
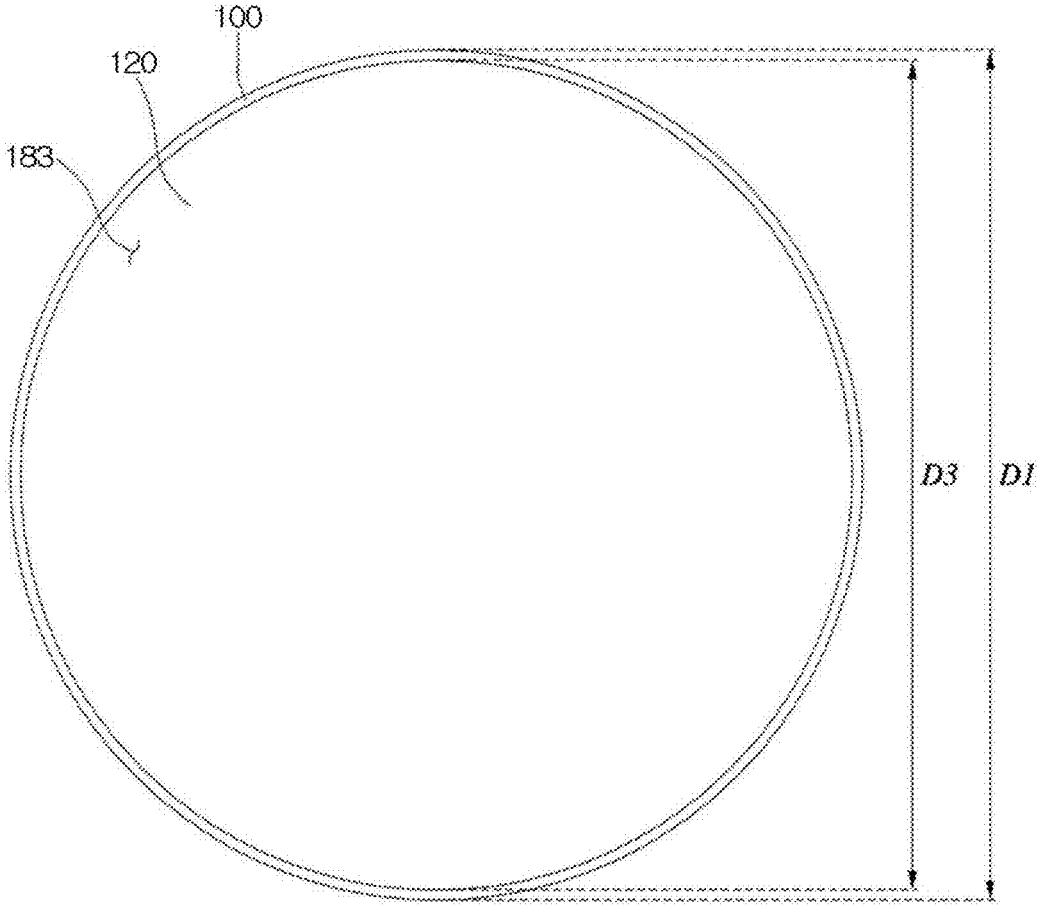
FIG. 4 is a bottom view of the lighting apparatus of FIG. 3.

Referring to FIGS. 1 to 11, a lighting apparatus 1000 may include a first body 100 having a first inner circumferential surface and a first outer circumferential surface, a cover 200 coupled with the first body 100 and including an open area 105 with an open bottom surface, a first reflecting member or reflector 250*a* provided in a central area of the open area 105 of the cover 200, a light emitting module 130 including a circuit board 130*a* provided on an inner surface of the cover 200 along an edge of the cover 200 and at least two light sources 130*b* mounted on the circuit board 130*a* to face each other, and an optical member 120 arranged below the open area 105 of the cover 200 and diffuses light emitted by the light emitting module 130. Here, the light sources 130*b* may be light emitting diodes (LEDs) but are not limited thereto.

As shown in FIGS. 1 to 4, the cover 200 may have a circular lower circumference, for example, an outline. The shape of the outline of the cover 200 may be an oval shape, a curved shape, or a polygonal shape with curved corners but is not limited thereto.

A diameter D1 of the cover 200 may be larger than a thickness D2 of the cover 200, and for example, the diameter D1 may be within a range four times or more, for example, four times to fifteen times of the thickness D2. The thickness D2 of the cover 200 may be reduced by employing the light source 130*b* therein. An emission area may be excessively narrow when the diameter D1 of the cover 200 is less than four times of the thickness D2 and light uniformity may be decreased and the optical member 120 may be displaced when the diameter D1 of the cover 200 is more than fifteen times of the thickness D2.

The cover 200 may be a plastic material, and for example, may include at least one of polycarbonate (PC), polyethylene terephthalate glycol (PETG), polyethylene (PE), polystyrene paper (PSP), polypropylene (PP), and polyvinyl chloride (PVC) but is not limited thereto. The cover 200 may be formed of a material with high light reflectance, and a reflecting layer may be further provided on the inner surface of the cover 200 but is not limited thereto.

The cover 200 may include a component accommodating portion 113 on top. The component accommodating portion 113 may have a shape protruding above a center of the cover 200, and a bracket 135 with which a power supply member 210 and a socket 144 are coupled may be disposed in the component accommodating portion 113. The power supply member 210 or the socket 144 may be fastened to or adhered to a top of the cover 200 using a fastening member or an adhesive member but is not limited thereto.

A top surface of the component accommodating portion 113 of the cover 200 may be flat. The socket 144 may be coupled to a socket hole 115 formed in the component accommodating portion 113. A buffering member 221 may be arranged above the component accommodating portion 113. The buffering member 221 may space the cover 200 from a fixed object such as a ceiling and may electrically and mechanically protect the cover 200. The buffering member 221 may be a rubber material but is not limited thereto.

Figure 5:
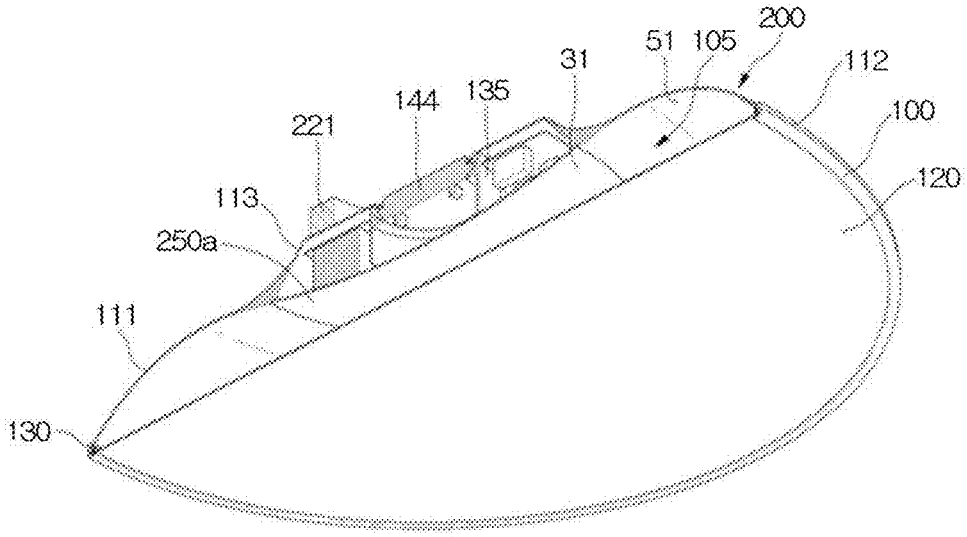
FIG. 5 is a perspective view illustrating a side cross section of the lighting apparatus of FIG. 3.

As shown in FIGS. 1 and 5, the cover 200 may include a reflecting portion 111 and an outer portion 112. The reflecting portion 111 may be formed as a curved surface having a certain curvature on an outer perimeter of the component accommodating portion 113. The reflecting portion 111 may be a curved surface having a certain curvature from the outer portion 112 in a circular shape and may extend toward a central portion of the cover 200. A plurality of ribs 118 may be arranged on an outer surface between the reflecting portion 111 and the component accommodating portion 113 and may reinforce a section between the reflecting portion 111 and the component accommodating portion 113.

Figure 6:
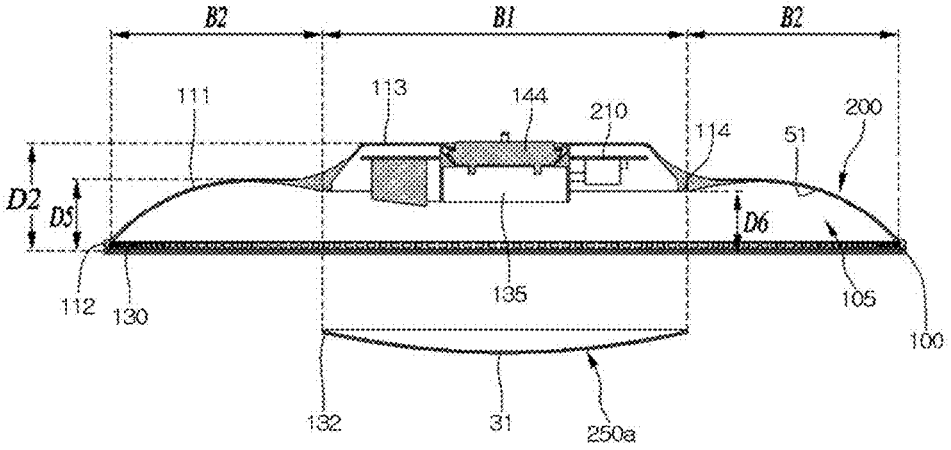
FIGS. 6 and 7 illustrate an example of combining a cover of the lighting apparatus of FIG. 1 with a first reflecting member.

As shown in FIGS. 5 and 6, the cover 200 may include the open area 105 with the open bottom, and the open area 105 may include a first reflecting surface 51 convex upward from the outer portion 112. The first reflecting surface 51 may have a side cross section in an arc shape. The first reflecting surface 51 described above may be an inner surface of the reflecting portion 111 and may include a reflecting layer attached on a surface but is not limited thereto.

Figure 9:
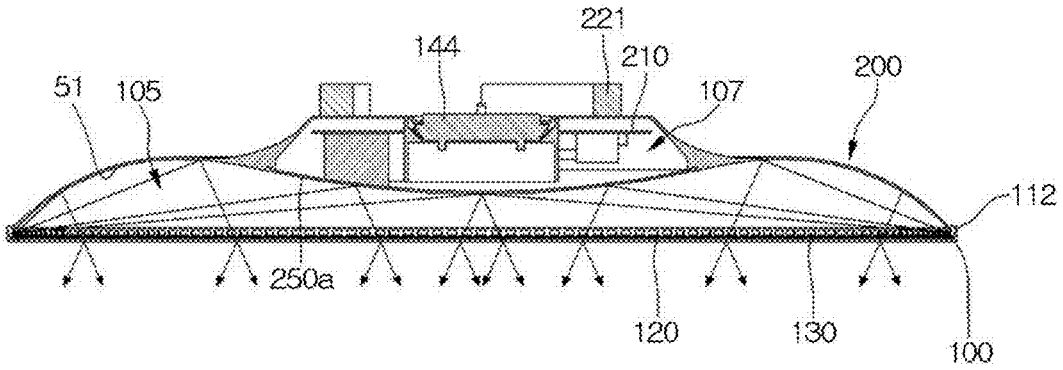
FIG. 9 is a side cross-sectional view of the lighting apparatus of FIG. 2.

As shown in FIG. 9, due to the arc convex upward from the outer portion 112 of the cover 200, the first reflecting surface 51 may be a cross section with a pair of arcs on both sides of the center of the cover 200. The first reflecting surface 51 in the shape of the pair of arcs may be spaced apart from the center of the cover 200 and may reflect light incident from the light source 130*b* to other areas of the optical member 120.

As shown in FIGS. 5 and 6, the cover 200 may include the outer portion 112 on an outer perimeter of the cover 200, for example, a lower edge thereof. The light emitting module 130 may be provided on the outer portion 112. The outer portion 112 may be arranged along an outer perimeter of the reflecting portion 111 and may protrude outward from a surface of the reflecting portion 111.

The outer portion 112 and the cover 200 may be integrated with each other but may be formed as different materials to be coupled. The outer portion 112 may protrude outward from an outer curved surface of the reflecting portion 111 on the outer perimeter of the cover 200, thereby increasing stiffness of the outer perimeter of the cover 200.

Figure 11:
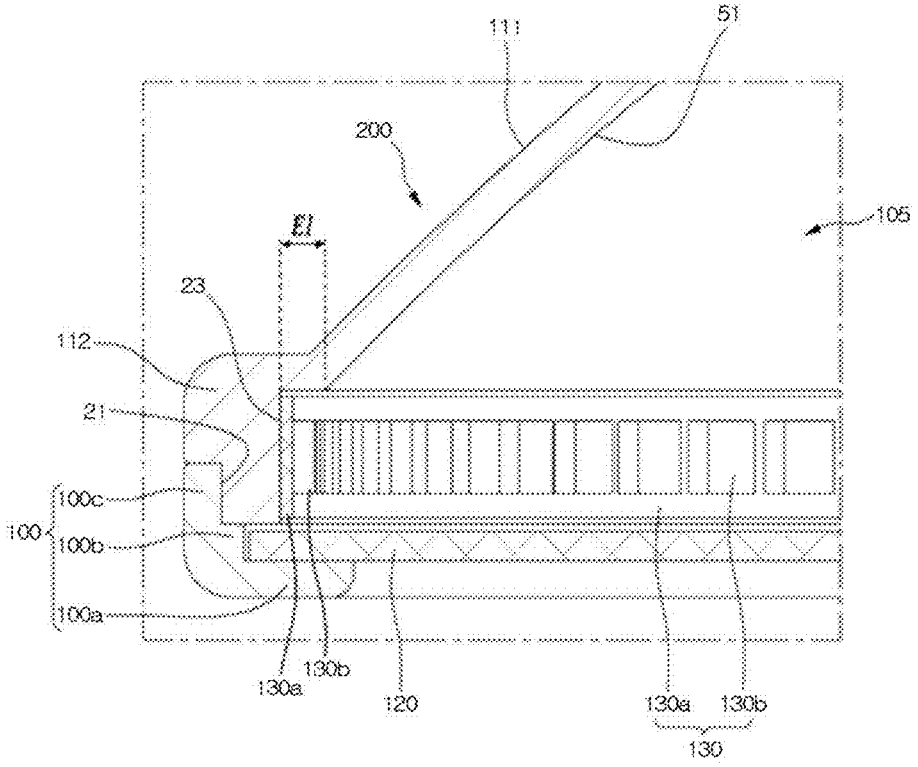
FIG. 11 illustrates a structure for combining a light emitting module with an optical member in the lighting apparatus of FIG. 9.

As shown in FIG. 11, the outer portion 112 of the cover 200 may include a recess 23 therein and the recess 23 may extend further outward from the light emitting module 130 with a certain depth E1 created from a bottom end of the first reflecting surface 51 of the reflecting portion 111. The depth E1 of the recess 23 may be larger than a thickness of the light source 130*b*, for example, larger than a thickness of the light emitting module 130. The recess 23 described above, considering a beam spreading angle property of the light source 130*b*, may be provided in an area which does not vertically overlap the first reflecting surface 51. The light emitting module 130 may be provided in the recess 23 in the outer portion 112. A heat dissipation body formed of a metal material may also be provided in an area between the recess 23 and the light emitting module 130 and the heat dissipation body may dissipate heat generated from the light emitting module 130.

The light emitting module 130 may include the circuit board 130*a* and a plurality of such light sources 130*b* arranged on the circuit board 130*a*. At least one or a plurality of such circuit boards 130*a* may be arranged along the outer portion 112 of the cover 200. The circuit board 130*a* may be a flexible board, or as another example, may include at least one of a printed circuit board (PCB) formed of a resin material, a metal core PCB (MCPCB), and a ceramic board, but is not limited thereto.

The light emitting module 130, for another example, may include the light source 130*b* without the circuit board 130*a*. In this case, a circuit pattern may be formed on an inner surface of the outer portion 112 and the light source 130*b* may be disposed on the circuit pattern.

The circuit board 130*a* may be attached to the outer portion 112 using an adhesive member or a heat dissipating adhesive. The circuit board 130*a* may be arranged vertically on the outer portion 112. A rear surface of the circuit board 130*a* may be positioned at 90° or within a range from 90° to 120° with a horizontal axis. The circuit board 130*a* may be arranged at an angle of 90° or more with the horizontal axis and an amount of light directly emitted to the optical member 120 among light emitted from the light source 130*b* may be reduced.

An emitting surface of the light source 130*b* may correspond to or deviate from the opposite circuit board 130*a*. The emitting surface of the light source 130*b* may be arranged at an angle of 90° or more with the horizontal axis. An optical axis vertical to the emitting surface of the light source 130*b* may be positioned below a second reflecting surface 31 or may correspond to the second reflecting surface 31.

The light source 130*b* may be arranged on the circuit board 130*a* in one or more rows but is not limited thereto. The light source 130*b* may emit at least one of blue, red, green, white, and ultraviolet (UV) light, and for example, may emit white light for lighting. The light source 130*b* may be arranged on the circuit board 130*a* in the form of a chip or a package. In this case, a beam spreading angle of the light source 130*b* may be 115° or more, for example, within a range from 118° to 150°, but is not limited thereto.

The light source 130*b* according to the embodiment may include a warm white LED and a cool white LED on the circuit board 130*a*. The warm white LED and the cool white LED may be diodes which emit white light. Since the warm white LED and the cool white LED emit correlated color temperatures to emit white light of mixed light, a color rendering index (CR1) which indicates nearness to natural sunlight may be increased. Accordingly, it may be possible to prevent actual color of an object from being distorted and to reduce eye strain of a user.

Figure 7:
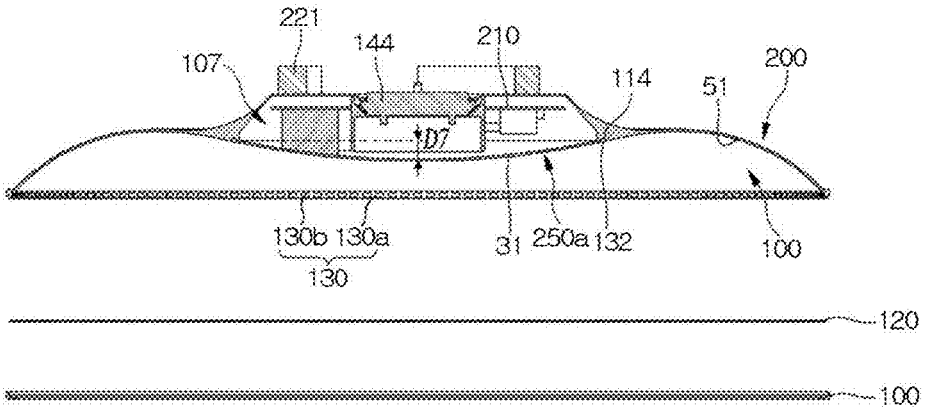

As shown in FIGS. 6 and 7, the first reflecting member 250*a* may be coupled with the open area 105 of the cover 200. Components such as the bracket 135, the power supply member or power supply 210, etc. may be arranged between the first reflecting member 250*a* and the component accommodating portion 113 of the cover 200. The first reflecting member 250*a* may be spaced apart from the component accommodating portion 113 of the cover 200. The first reflecting member 250*a* may include the second reflecting surface 31 convex below the cover 200 on which the optical member 120 is provided. The first reflecting member 250*a* may have a circular shape in a top view and a bottom view but is not limited thereto.

Figure 8:
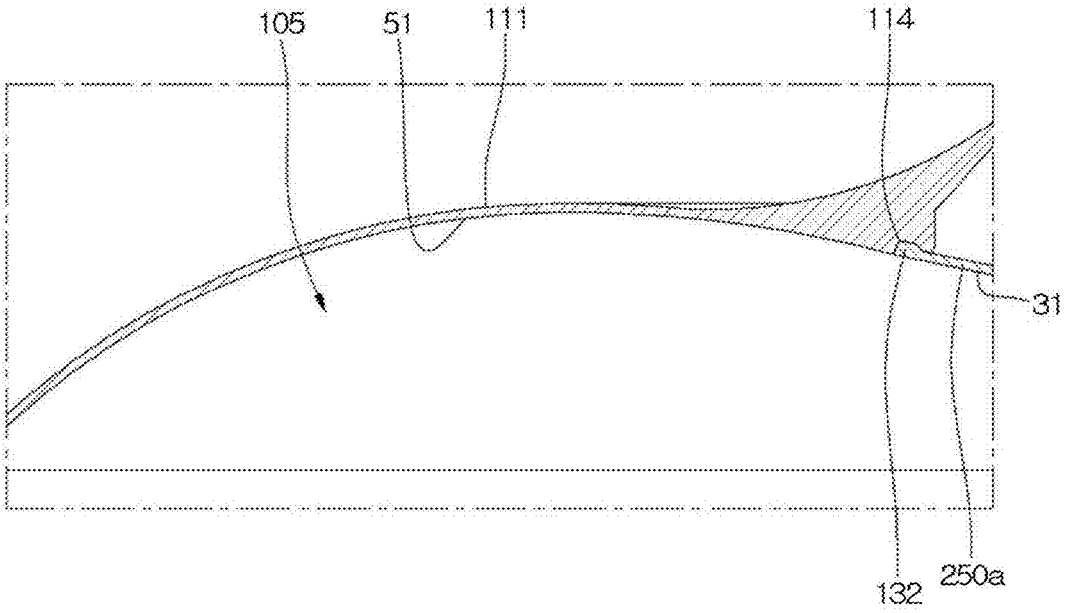
FIG. 8 is a partial enlarged view illustrating the cover and the first reflecting member of FIG. 7.

As shown in FIG. 8, a first coupling portion 114 may be provided in the cover 200 and may be formed at an end of the first reflecting surface 51 as a concave groove. The first coupling portion 114 may be formed in a circular shape along an inner edge of the first reflecting surface 51. The first coupling portion 114 may be formed at a position corresponding to an outer edge of the first reflecting member 250*a*.

The first reflecting member 250*a* may include a second coupling portion 132 which protrudes along the outer edge of the first reflecting member 250*a*. The second coupling portion 132 may be formed at a position corresponding to the first coupling portion 114 of the cover 200. The second coupling portion 132 may be formed in a convex protrusion shape corresponding to the concave groove.

The concave groove of the first coupling portion 114 and the convex protrusion of the second coupling portion 132 may be the same size and circular shape. The second coupling portion 132 may be coupled with the first coupling portion 114 in a holding structure, a detachable structure, or a hook structure. For example, in the holding structure, when an inlet of the first coupling portion 114 is a groove in a narrow shape, a hemispherical protrusion of the second coupling portion 132 is inserted in and held by the groove to be coupled. In the detachable structure, the first coupling portion 114 and the second coupling portion 132 may be attached to each other using an adhesive member, for example, an adhesive or an adhesive tape.

In the hook structure, a hook protrusion may be provided at the first coupling portion 114 and a hook groove or a hook hole may be provided at the second coupling portion 132 to be coupled with the hook protrusion. The first and second coupling portions 114 and 132 may be coupled with each other through different coupling structures but are not limited thereto. Although the first and second coupling portions 114 and 132 have been described as being formed along an outer perimeter of the first reflecting member 250*a*, they may be formed at a plurality of different positions but are not limited thereto.

Figure 10:
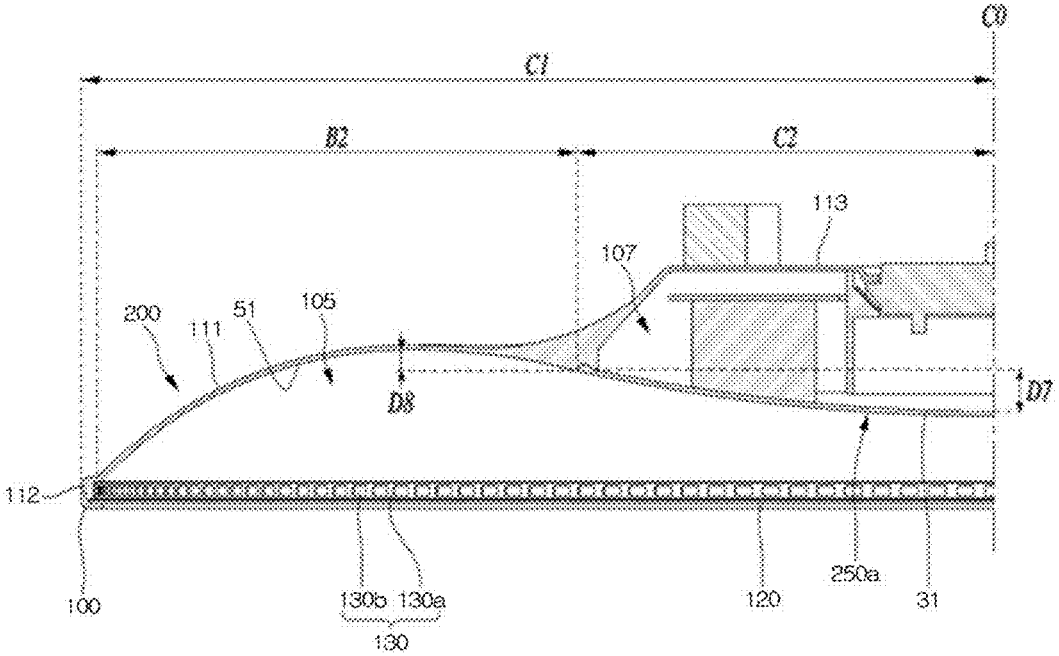
FIG. 10 illustrates first and second reflecting surfaces in the cover of the lighting apparatus of FIG. 9.

As shown in FIG. 10, when the second reflecting surface 31 of the first reflecting member 250*a* has a structure which protrudes toward a bottom surface of the cover 200 on which the optical member 120 is provided when approaching a central axis C0 of the cover 200, a gap between the second reflecting surface 31 and a top surface of the optical member 120 may become narrower. Particularly, the first reflecting member 250*a* may have a second radius C2 smaller than a first radius C1 of the cover 200 based on the central axis C0 of the cover 200. The first and second radii C1 and C2 indicate linear distances from side cross sections to the central axis C0. The second reflecting surface 31 of the first reflecting member 250*a* may have the first radius C1 based on the central axis C0 of the cover 200, and the first reflecting surface 51 may have a certain breadth B2 from an end point of the first radius C1 that is, a boundary point of the first and second reflecting surfaces 51 and 31.

The breadth B2 of the first reflecting surface 51 may be smaller than a diameter B1 of the second reflecting surface 31 as shown in FIG. 6. The diameter B1 or breadth of the second reflecting surface 31 may be larger than the breadth B2 of the first reflecting surface 51, thereby improving light intensity in an area of the center of the cover 200. A height D5 of the reflecting portion 111 may be lower than the thickness D2 of the cover 200 to provide the outer portion 112 of the cover 200, which is slim.

As shown in FIGS. 7 and 8, the second reflecting surface 31 of the first reflecting member 250*a* may extend to a curved surface continued to an inside of the first reflecting surface 51. Accordingly, the occurrence of an arm portion caused by a boundary portion between the second reflecting surface 31 and the first reflecting surface 51 may be suppressed.

As shown in FIGS. 7 and 10, the boundary portion between the second reflecting surface 31 and the first reflecting surface 51 may be a low point portion of the inside of the first reflecting surface 51 and may be a high point portion of the second reflecting surface 31. A horizontal line which passes both ends of the second reflecting surface 31 may be a certain height D7 above a low point of the second reflecting surface 31 and may be a certain height D8 below a high point of the first reflecting surface 51. A height difference (D7+D8) between the first and second reflecting surfaces 51 and 31 may be different depending on curvature radii of the high point and the low point of the first and second reflecting surfaces 51 and 31.

A curvature radius of the second reflecting surface 31 may be different from a curvature radius of the first reflecting surface 51. For example, the curvature radius of the second reflecting surface 31 may be larger than the curvature radius of the first reflecting surface 51, thereby improving light uniformity of a center of the optical member 120. The curvature radius of the first reflecting surface 51 may be smaller than the curvature radius of the second reflecting surface 31, thereby reflecting incident light to an area adjacent to the center. Accordingly, the first reflecting surface 51 and the second reflecting surface 31 may uniformly emit the incident light to the whole area of the optical member 120.

As shown in FIG. 10, the low point of the second reflecting surface 31 may be provided above an optical axis of the light source 130*b*. The optical axis may be an axis vertical to the emitting surface of the light source 130*b*. As another example, a bottom of the second reflecting surface 31 may be provided on the optical axis of the light source 130*b*. The light incident on the second reflecting surface 31 may be reflected by the second reflecting surface 31 and may proceed to a central area of the optical member 120.

As shown in FIGS. 6, 7, and 11, when the first reflecting member 250*a* is coupled with the cover 200, the optical member 120 may be below the open area 105 of the cover 200. The light emitting module 130 may be provided in the cover 200 before coupling between the first reflecting member 250*a* and the cover 200 or may be coupled with the inside of the cover 200 after coupling between the first reflecting member 250*a* and the cover 200 but is not limited thereto.

The optical member 120 may be arranged below the open area 105 of the cover 200 and the optical member 120 may vertically overlap the open area 105 of the cover 200. A maximum diameter D3 of the open area 105 may be smaller than the diameter D1 of the cover 200.

An edge of the optical member 120 may protrude further outward than the light emitting module 130, and the optical member 120 may be below the light emitting module 130 in such a way that an outer perimeter of the optical member 120 may extend below the circuit board 130*a* of the light emitting module 130. Accordingly, the optical member 120 may prevent a light leaking phenomenon in which light emitted from the light source 130*b* is directly exposed.

The optical member 120 may include a diffusion sheet. The diffusion sheet may diffuse and emit light incident through the light source 130*b* and the first and second reflecting surfaces 51 and 31 to a lighting area with uniform light intensity.

The optical member 120 may include a diffusing material, for example, at least one of polymethylmethacrylate (PMMA), polypropylene (PP), polyethylene (PE), and polystyrene (PS). A plurality of optical sheets may be provided on the optical member 120 but are not limited thereto.

The first body 100 may be provided on the outer perimeter of the optical member 120. The first body 100 may include a first inner circumferential surface and a first outer circumferential surface and may extend along the outer perimeter of the cover 200. The first body 100 may be provided along a perimeter of the outer portion 112 of the cover 200 and may be fastened to the outer portion 112 of the cover 200.

As shown in FIG. 11, the first body 100 may include a bent portion 100*c* and a supporting portion 100*a*, and the bent portion 100*c* may be coupled with the outer portion 112 of the cover 200. The outer portion 112 of the cover 200 may include a step structure 21 formed at an outer surface of the cover 200 to be concave toward an inside of the lighting apparatus 1000, and the bent portion 100*c* of the first body 100 may be coupled with the step structure 21 of the outer portion 112. The outer portion 112 and the bent portion 100*c* of the cover 200 may be fastened using a fastening member such as a screw, may be attached using an adhesive, or may be coupled in a hook or holding structure but are not limited thereto.

The supporting portion 100*a* of the first body 100 may extend to vertically overlap the light emitting module 130 and may support a bottom surface of the outer perimeter of the optical member 120. The supporting portion 100*a* may prevent the optical member 120 from flowing or being deviated below the lighting apparatus 1000. The supporting portion 100*a* of the first body 100 may vertically overlap the light source 130*b* but is not limited thereto.

The first body 100 may further include a protruding portion 100*b* having a step in an area between the supporting portion 100*a* and the bent portion 100*c*, and the protruding portion 100*b* may be attached to the bottom surface of the cover 200, specifically a bottom surface of the outer portion 112. Accordingly, it may be possible to prevent a light leakage to a boundary area between the first body 100 and the cover 200.

The first body 100 may be a metal material or plastic material. When the first body 100 is metal, the first body 100 may include at least one of aluminum, an aluminum alloy, silver, and a silver alloy. When the first body 100 is a plastic material, the first body 100 may include at least one of PC, PETG, PE, PSP, PP, and PVC.

As shown in FIG. 9, the lighting apparatus 1000 may include the first reflecting surface 51 having a curved surface convex upward on an outer perimeter of the open area 105 of the cover 200 and the first reflecting member 250*a* including the second reflecting surface 31 having a curved surface convex downward in the central area of the open area 105, thereby uniformly reflecting light emitted from the light source 130*b* disposed on the edge of the cover 200 to the whole area of the optical member 120 by the first reflecting surface 51 and the second reflecting surface 31. Accordingly, light uniformity of the optical member 120 may be improved.

Particularly, since unified glare rating (UGR) of the lighting apparatus 1000 may be 19 or less, there may be no unpleasant glare to a user. In a counter immuno electrophoresis (CIE) regulation, when the UGR is 21 or more, it is classified that the user feels displeasure.

Figure 12:
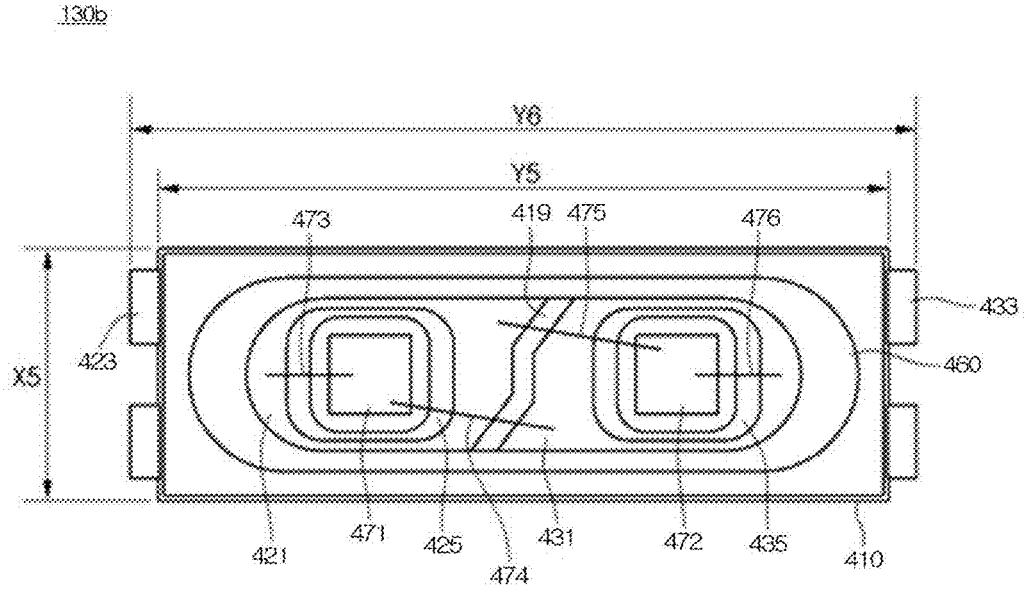
FIG. 12 is a plan view of a light emitting diode (LED) of the lighting apparatus according to the embodiment.
Figure 13:
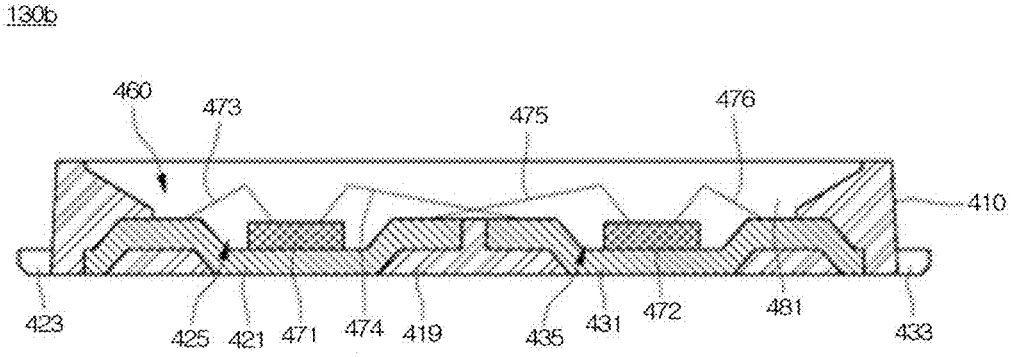
FIG. 13 is a side cross-sectional view of the LED of FIG. 12.

Referring to FIGS. 12 and 13, the light source 130*b* may include a body 410 having a concave portion 460, a plurality of lead frames 421 and 431 in the concave portion 460, and at least one of light emitting chips 471 and 472 in the concave portion 460. The body 410 may include an insulating material or conductive material. The body 410 may be formed of at least one of a resin material such as polyphthalamide (PPA), silicon (Si), a metal material, photo sensitive glass (PSG), sapphire ($Al_2O_3$), and a PCB. For example, the body 410 may be formed of a resin material, for example, PPA, epoxy, or silicone.

A filler which is a metal oxide such as $TiO_2$ and $SiO_2$ may be added to the epoxy or silicone used as the body 410 to increase reflection efficiency. The body 410 may include a ceramic material. The body 410, as another example, may include a circuit board and may include, for example, at least one of a PCB formed of a resin material, a metal core PCB having heat dissipation metal, and a ceramic board. The body 410 may formed in a dark color or black color to improve contrast but is not limited thereto.

The body 410 may include the concave portion 460 having a certain depth. The concave portion 460 may be concave from a top surface of the body 410 in a concave cup structure, a cavity structure, or a recess structure but is not limited thereto. A sidewall of the concave portion 460 may be vertical to or inclined to a bottom, and two or more sidewalls may be arranged at the same angle or different angles. Although not shown in the drawings, a reflecting layer formed of a different material may be further provided on the surface of the concave portion 460 but is not limited thereto.

The shape of the body 410 may be a polygonal structure such as a triangle, a quadrangle, and a pentagon, a circle, an oval, or a curved surface, or a polygonal shape with curved corners in a top view but is not limited thereto. An outer surface of the body 410 may be vertical or inclined to a bottom surface of the body 410 but is not limited thereto. A length Y5 and a width X5 of the body 410 may be different. For example, the length Y5 may be two times or more of the width X5, specifically three times or more, and may be shorter than a maximum length Y6 of the light source 130*b*. A longitudinal direction of the body 410 may be a direction which intersects a width direction. A plurality of such light emitting chips 471 and 472 may be arranged in the longitudinal direction in the light source 130*b*.

The plurality of light emitting chips 471 and 472 may be arranged in the longitudinal direction at a certain interval in the light source 130*b* but a direction in which the plurality of light emitting chips 471 and 472 are arranged is not limited thereto. In the light source 130*b*, each of the light emitting chips 471 and 472 may be provided on each of the lead frames 421 and 431 in an aspect of heat dissipation, or a plurality of light emitting chips may be provided on one lead frame. The light source 130*b* may allow a length to be longer than a width, thereby improving heat dissipation efficiency of each of the light emitting chips 471 and 472 and increasing a size of the light emitting chips 471 and 472 to provide a device with high brightness.

The plurality of lead frames 421 and 431 may be arranged on the concave portion 460 of the body 410. The plurality of lead frames 421 and 431 may include at least two or three metal frames, for example, first and second lead frames 421 and 431. The first and second lead frames 421 and 431 may be separated by a gap portion 419.

One or the plurality of light emitting chips 471 and 472 may be arranged in the concave portion 460. The plurality of light emitting chips 471 and 472 may include at least two or three LED chips, for example, first and second light emitting chips 471 and 472. One or the plurality of light emitting chips 471 and 472 may be arranged above at least one of the plurality of lead frames 421 and 431. For example, at least one light emitting chip 471 or 472 may be arranged above each of the plurality of lead frames 421 and 431. The plurality of light emitting chips 471 and 472 may be selectively connected to the plurality of lead frames 421 and 431. Each of the light emitting chips 471 and 472 may be defined as a light source.

At least one of the plurality of lead frames 421 and 431 may include a cavity having a greater depth than a bottom of the concave portion 460. The first lead frame 421 may include a first cavity 425, and the first cavity 425 may be depressed to a greater depth than the bottom of the concave portion 460. The first cavity 425 may include a shape concave toward the bottom surface of the body 410 from the bottom of the concave portion 460, for example, a cup structure or a recess shape. The first cavity 425 may be formed by bending or etching the first lead frame 421 but is not limited thereto.

Sidewalls and a bottom of the first cavity 425 may be formed by the first lead frame 421, and a perimeter sidewall of the first cavity 425 may be formed to incline from the bottom of the first cavity 425. Two sidewalls of the sidewalls of the first cavity 425 which face each other may incline at the same angle or at different angles. Also, frame thicknesses of the sidewalls and bottom of the first cavity 425 may be the same thickness as that of the first lead frame 421.

The second lead frame 431 may include a second cavity 435. The second cavity 435 may be depressed to a greater depth than the bottom of the concave portion 460. The second cavity 435 may include a shape concave toward the bottom surface of the body 410 from a top surface of the second lead frame 431 or the bottom of the concave portion 460, for example, a cup structure or a recess shape. The second cavity 435 may be formed by bending or etching the second lead frame 431 but is not limited thereto.

A bottom and sidewalls of the second cavity 435 may be formed by the second lead frame 431, and the sidewalls of the second cavity 435 may be formed to incline from the bottom of the second cavity 435. Two sidewalls of the sidewalls of the second cavity 435 which face each other may incline at the same angle or at different angles. Frame thicknesses of the sidewalls and bottom of the second cavity 435 may be the same thickness as that of the second lead frame 431. Bottom shapes of the first cavity 425 and the second cavity 435 may be polygonal shapes, polygonal shapes with a partially curved surface, circular shapes, or oval shapes but are not limited thereto.

Parts of the bottom surfaces of the first lead frame 421 and the second lead frame 431 may be exposed below the body 410 and may be arranged on the same plane as the bottom surface of the body 410 or a different plane. The parts of the bottom surfaces of the first lead frame 421 and the second lead frame 431 may include surfaces opposite to the bottoms of the first and second cavities 425 and 435. Also, the surfaces opposite to the bottoms of the first and second cavities 425 and 435 may be exposed to the bottom surface of the body 410.

The first lead frame 421 may include a first lead portion 423, and the first lead portion 423 may protrude toward an outer surface portion of the body 410. The second lead frame 431 may include a second lead portion 433, and the second lead portion 433 may protrude toward the outer surface portion of the body 410. One or a plurality of such first lead portions 423 may protrude, and one or a plurality of such second lead portions 433 may protrude. The first and second lead portions 423 and 433 may protrude in opposite directions based on the concave portion 460 but are not limited thereto.

The first lead frame 421 and the second lead frame 431 may include a metal material, for example, at least one of titanium (Ti), copper (Cu), nickel (Ni), gold (Au), tantalum (Ta), platinum (Pt), tin (Sn), silver (Ag), and phosphorus (P) and may be formed as single layers or multiple layers. Thicknesses of the first and second lead frames 421 and 431 may be formed to be 0.15 mm or more, for example, within a range from 0.18 mm to 1.5 mm. When the thicknesses of the first and second lead frames 421 and 431 are less than 0.15 mm, it may be difficult to perform injection molding. Also, when the thicknesses of the first and second lead frames 421 and 431 are more than 1.5 mm, a thickness and a size of the light source 130*b* may increase and may cause an increase in material costs. Also, when the thicknesses of the first and second lead frames 421 and 431 are less than 0.15 mm, electrical properties and heat dissipation properties may decrease.

The first and second lead frames 421 and 431 may be formed to have the same thicknesses but are not limited thereto. The first and second lead frames 421 and 431 may function as lead frames which supply power. In the concave portion 460, a metal frame for heat dissipation in addition to the first and second lead frames 421 and 431 or an intermediate frame for electrically connecting the first and second lead frames 421 and 431 may be further provided but it is not limited.

The first light emitting chip 471 may be provided in the first cavity 425 of the first lead frame 421, and for example, the first light emitting chip 471 may be adhered to the first cavity 425 using an adhesive but is not limited thereto. The second light emitting chip 472 may be provided in the second cavity 435 of the second lead frame 431, and for example, the second light emitting chip 472 may be adhered to the second cavity 435 using an adhesive but is not limited thereto. The adhesive may be an insulating adhesive or a conducting adhesive. The insulating adhesive may include a material such as epoxy or silicone, and the conducting adhesive may include a bonding material such as solder.

The first and second light emitting chips 471 and 472 may selectively emit light in a range from a visible ray band to an ultraviolet ray band, and for example, may be selected from an ultraviolet LED chip, a red LED chip, a blue LED chip, a green LED chip, a yellow green LED chip, and a white LED chip. The first and second light emitting chips 471 and 472 may include LED chips including at least one of a compound semiconductor of a III-V group element and a compound semiconductor of a II-VI group element.

The first and second light emitting chips 471 and 472 may be in a horizontal chip structure in which two electrodes are provided adjacent to each other in a chip or a vertical chip structure in which two electrodes are provided opposite to each other but are not limited thereto. When the first and second light emitting chips 471 and 472 are horizontal chips, a lower insulating board may be adhered to a lead frame using an insulating or conducting adhesive. When the first and second light emitting chips 471 and 472 are vertical chips, a lower electrode of the vertical chip may be electrically connected to a lead frame using a conducting adhesive.

The first light emitting chip 471 may be connected to the first lead frame 421 provided on the bottom of the concave portion 460 using a first wire 473 and may be connected to the second lead frame 431 using a second wire 474 but is not limited thereto. The second light emitting chip 472 may be connected to the first lead frame 421 using a third wire 475 and may be connected to the second lead frame 431 provided on the bottom of the concave portion 460 using a fourth wire 476 but is not limited thereto.

The light source **130*b* may include a protecting element. The protecting element may be provided on a part of the first lead frame 421 or the second lead frame 431. The protecting element may be provided in the body 410. The protecting element may be embodied as a thyristor, a zener diode, or a transient voltage suppression. The zener diode may protect the first and second light emitting chips 471 and 472 from electrostatic discharge. The protecting element may be connected to connection circuits of the first light emitting chip 471 and the second light emitting chip 472** in parallel.

A molding member 481 may be formed in the concave portion 460 and at least one of the first cavity 425 and the second cavity 435. The molding member 481 may include a transparent resin layer such as a silicone or epoxy and may be formed as a single layer or multiple layer. At least one kind of a fluorescent substance may be added to the molding member 481.

A surface of the molding member 481 may be formed in a flat shape, a concave shape, a convex shape, etc. but is not limited thereto. The light source **130*b* may be a blue light emitting device and may be a white light emitting device with high color rendering index (CRI). The light source 130*b*** may be a light emitting device which is formed by molding a top of a blue light emitting chip with a composite resin including a fluorescent substance and may emit white light. The fluorescent substance may include at least one of garnet-based YAG and TAG, silicate-based, nitride-based, and oxynitride based.

In the lighting apparatus 1000 according to the first embodiment described above, the light sources **130*b* may be arranged along an outer shape of the cover 200 and light emitted from the light sources 130*b* and incident on the optical member 120 may be emitted below the lighting apparatus 1000. Here, the cover 200 may include the first reflecting surface 51 in an arc shape convex upward from the outer portion 112 of the cover 200 and the first reflecting member 250*a* may include the second reflecting surface 31 convex toward the bottom of the lighting apparatus 1000 from which light is emitted, thereby increasing light emission uniformity to improve reliability of the lighting apparatus 1000**.

Figure 14A:
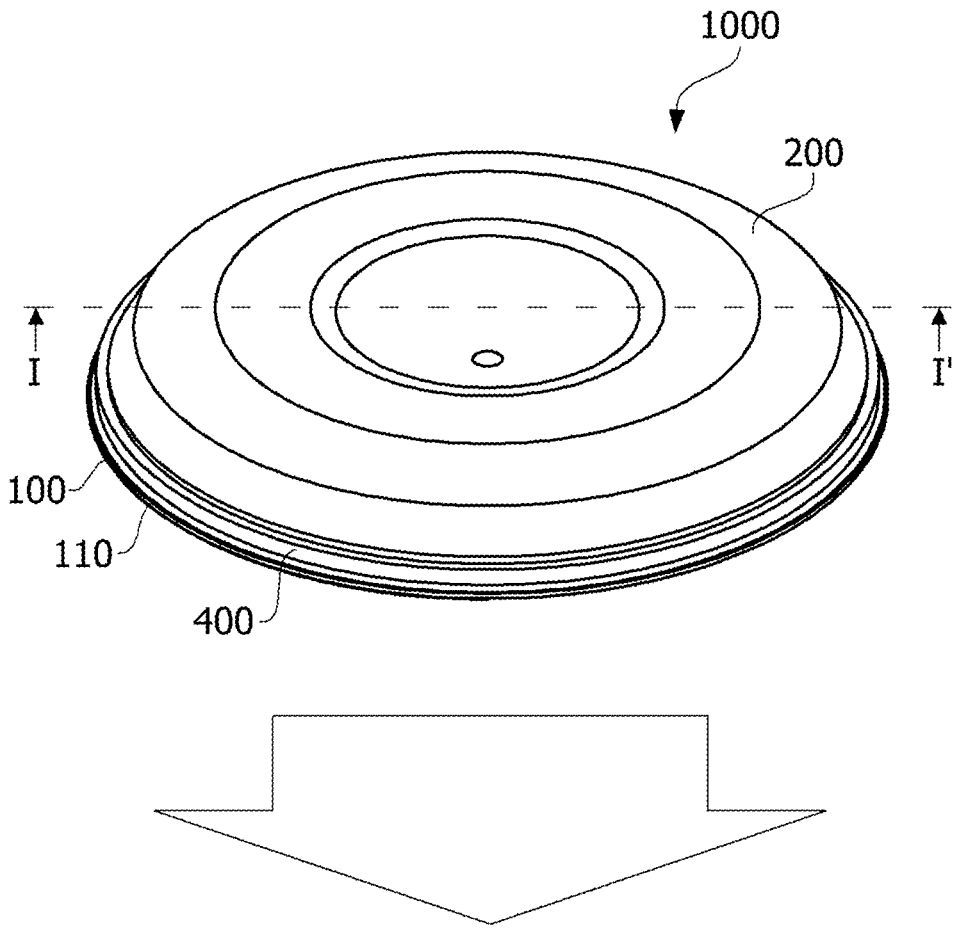
FIG. 14A is a top perspective view of a lighting apparatus according to a another embodiment of the present disclosure.
Figure 14B:
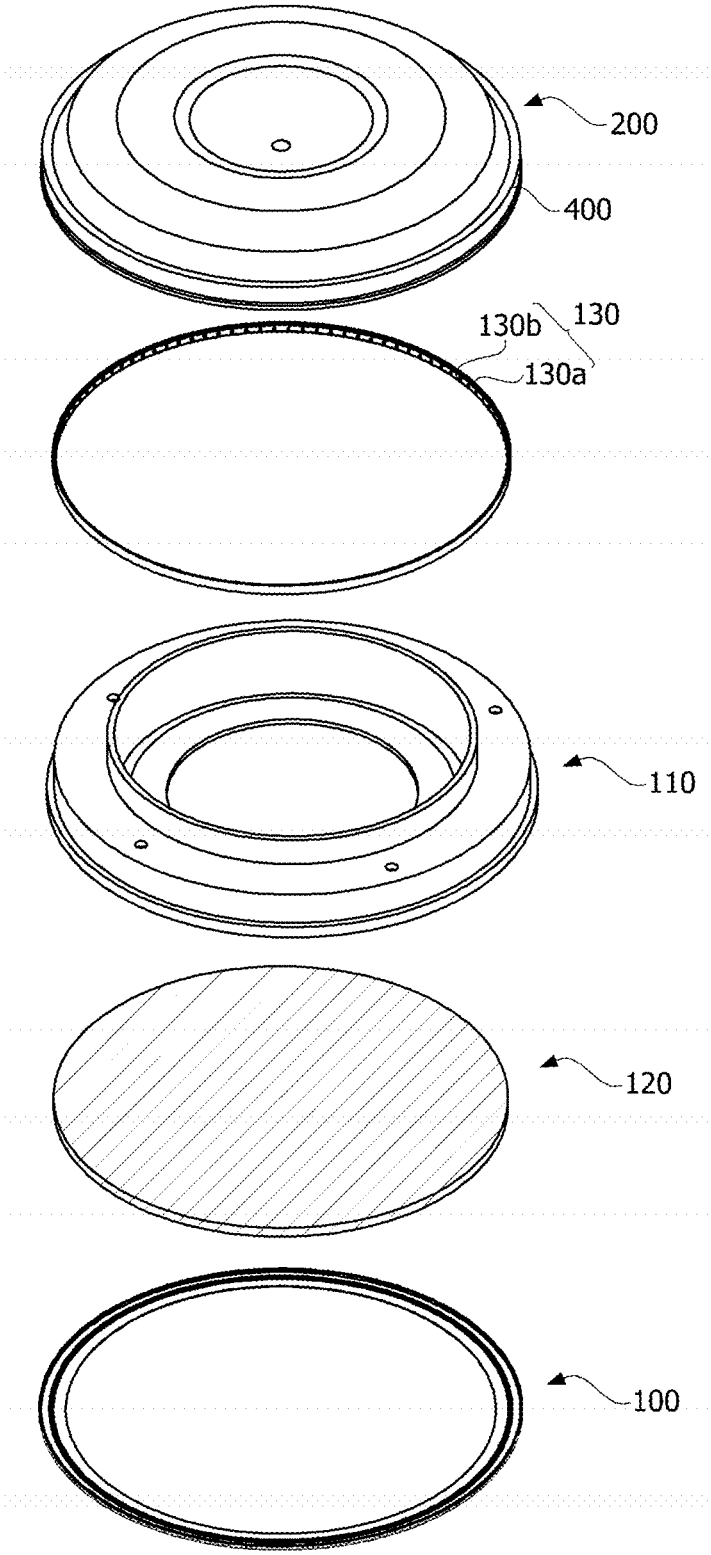
FIG. 14B is an exploded perspective view of the lighting apparatus of FIG. 14A.
Figure 15A:
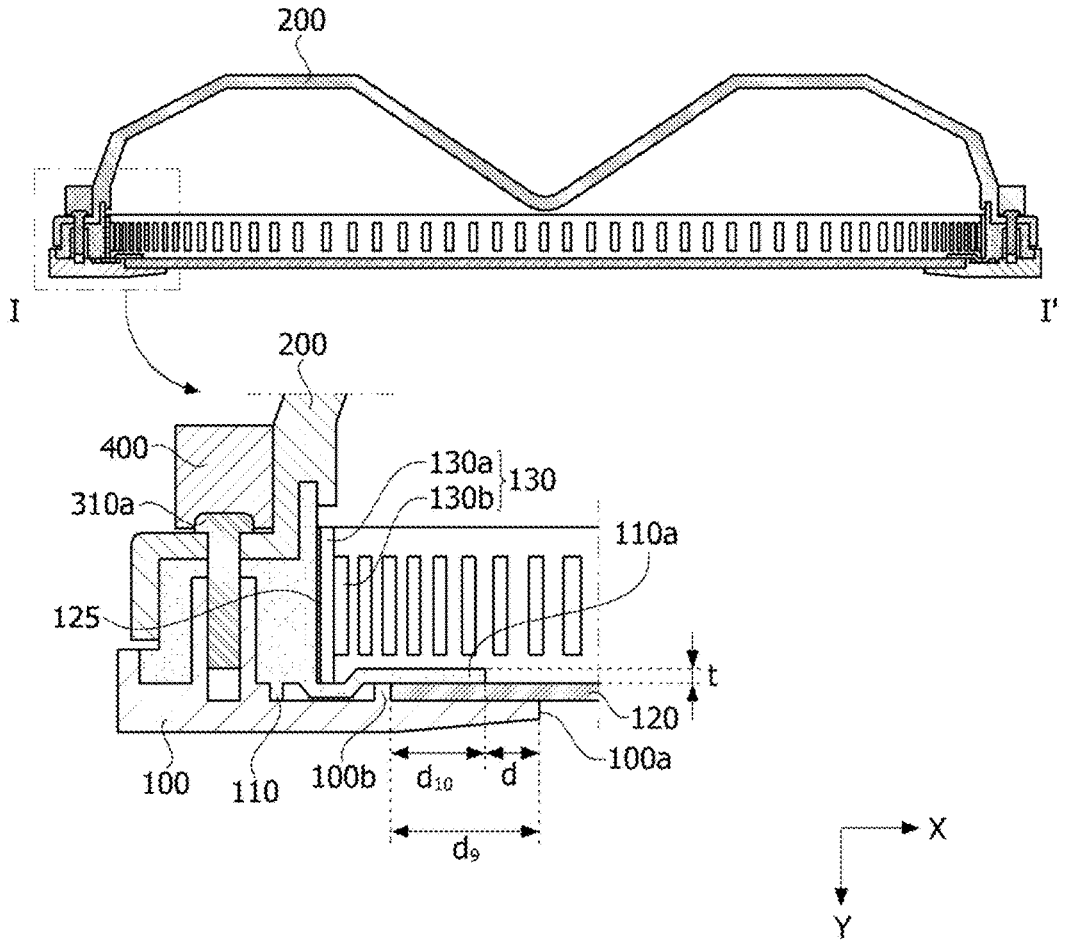
FIG. 15A is a cross-sectional view illustrating a part taken along line I-I of FIG. 14A.

As shown in FIGS. 14A, 14B, and 15A, the lighting apparatus 1000 according to another embodiment may include the first body 100 including a first inner circumferential surface and a first outer circumferential surface, the optical member 120 in a plate shape mounted on the first body 100 while an edge thereof is in contact with a top surface of the first body 100, a second body 110 which includes a second inner circumferential surface and a second outer circumferential surface and is fastened to the first body 100 to partially surround an edge of a top surface of the optical member 120, a light source member 130 which includes the circuit board **130*a* provided on the second body 110 to be parallel to a light emission direction Y of the optical member 120 and at least two light sources 130*b* mounted on the circuit board 130*a* to face each other, and the cover 200 fixed to the first body 100 and the second body 110 to cover the light source member 130**.

The first body 100 may be formed in a ring shape having the first inner circumferential surface and the first outer circumferential surface to have an open central portion. The first body 100 may be a plastic material and may be formed through an injection method. For example, the first body 100 may be PC. For example, the first body 100 formed of a plastic material may be lighter in weight and may have further reduced manufacturing costs than a case in which the first body 100 is formed of a metal material. However, the material of the first body 100 is not limited thereto.

The optical member 120 may be exposed in the open central portion of the first body 100. Accordingly, light generated by the light source member 130 may be diffused by the optical member 120 exposed below the first body 100 and may be emitted outward. In the drawings, emission of light from a bottom surface of the lighting apparatus 1000 is shown.

The optical member 120 may have a plate shape with a circular or oval edge. For example, the shape of the optical member 120 may be easily adjusted depending on shapes of the first body 100 and the second body 110. The optical member 120 may be provided between the first body 100 and the second body 110 and may have a structure in which an edge thereof is surrounded by the first body 100 and the second body 110.

To mount the optical member 120, the first body 100 may include a horizontal portion **100*a* having a flat top surface. Also, the protruding portion 100*b* which protrudes from the horizontal portion 100*a* may fix an edge of the optical member 120. An edge of a bottom surface of the optical member 120 may be mounted on the horizontal portion 100*a*, and a side surface of the optical member 120 may be in close contact with the protruding portion 100*b***.

The second body 110 may be provided on the first body 100 and may be fastened to the first body 100 to cover an edge of the top surface of the optical member 120. The second body 110 may be formed of the same material as that of the first body 100, or the first body 100 and the second body 110 may be integrated. The first body 100 and the second body 110 may be independent components. Particularly, the second body 110 may be formed of a material with excellent heat conductance such as Al, Cu, Ag, Au, etc. to function as a heat sink.

The second body 110 may include a horizontal portion 110*a* in contact with an edge of the top surface of the optical member 120. The edge of the optical member 120 may be in contact between the horizontal portion 100*a* of the first body 100 and the horizontal portion 110*a* of the second body 110 in such a way that the horizontal portion 100*a* of the first body 100 and the horizontal portion 110*a* of the second body 110 may overlap with each other with the optical member 120 therebetween.

The light source member 130 may be provided on an inner surface of the second body 110. The light source member 130 may include the circuit board 130*a* and at least two light sources 130*b* mounted on the circuit board 130*a*. The circuit board 130*a* may have a ring shape like the second body 110. The circuit board 130*a* may be provided along the inner surface of the second body 110 and may be in contact with the inner surface of the second body 110. Accordingly, when the second body 110 functions as a heat sink, heat generated from the light source member 130 may be easily emitted through the second body 110.

The circuit board 130*a* may be a PCB formed of polyethylene terephthalate (PET), glass, PC. Si, etc. on which a plurality of such light sources 130*b* are mounted. The circuit board 130*a* may be formed in a film shape or may be selected from a single layer PCB, a multiple layer PCB, a ceramic board, a metal core PCB, etc.

The circuit board 130*a* may be provided on the inner surface of the second body 110 to be parallel to the light emission direction Y of the optical member 120 in such a way that at least two light sources 130*b* may be mounted on the circuit board 130*a* to face each other. Light emitted from the light sources 130*b* may be emitted in a direction X perpendicular to the light emission direction Y of the optical member 120 and may be reflected by an inner surface of the cover 200 at least one time to proceed to the optical member 120 or the light emitted from the light sources 130*b* may be directly incident on the optical member 120.

The light sources 130*b* may be LED chips. The LED chip may be configured as a blue LED chip or an ultraviolet LED chip or may be configured as a package combining at least one of a red LED chip, a green LED chip, a blue LED chip, a yellow green LED chip, and a white LED chip.

The cover 200 may be provided on the second body 110 to cover the light source member 130 described above. The cover 200 may be fastened to at least one of the first body 100 and the second body 110 to surround the light source member 130. The cover 200 may be fastened to the first and second bodies 100 and 110. The cover 200, the first body 100, and the second body 110 may be fastened using a first fastening member or fastener 310*a* such as a screw, etc. or may be adhered using an adhesive member but are not limited thereto. The first fastening member 310*a* may couple the cover 200, the first body 100, and the second body 110 at an edge of the lighting apparatus.

A sealing member 400 may be provided on the cover 200 to surround the first fastening member 310*a*. The sealing member 400 may include epoxy, an acryl resin, etc. but is not limited thereto. The sealing member 400 may prevent the first fastening member 310*a* from being separated from the first body 100, the second body 110, and the cover 200.

The cover 200 may be formed of a material with high reflectance to reflect light emitted from the light source member 130 to the optical member 120. For example, the cover 200 may include white silicone such as phenyl silicone and methyl silicone and may have a structure which further includes reflecting particles in addition to the white silicone to increase reflectance. For example, the cover 200 may be glass in which TiO2 is distributed but is not limited thereto. The inner surface of the cover 200 described above may diffusely reflect the light emitted from the light source member 130 and may reflect light incident on the cover 200 to the optical member 120 in Lambertian distribution.

The cover 200 may be formed of a material such as glass, plastic, PP, PE, PC, etc. and a material which reflects light such as Ag, Al, etc. may be additionally applied, printed, or attached, as a film type, to or may additionally coat the inner surface of the cover 200. The cover 200 is not limited thereto but may include various materials.

The cover 200 may have a concave area corresponding to a central portion of the optical member 120 but is not limited thereto. For example, when the cover 200 includes the concave area as shown in the drawings, a power supply portion that drives the light source member 130, etc. may be further provided in the concave area of the cover 200.

As described above, a first light which is emitted from the light source 130*b* and proceeds directly to the optical member 120 and a second light which is reflected by the inner surface of the cover 200 at least one time and proceeds to the optical member 120 may be incident on the optical member 120. However, a general lighting apparatus may have a limitation in which a band-shaped shadow is formed at the edge of the optical member 120 due to the first light which does not arrive at the edge of the optical member 120.

Figure 16:
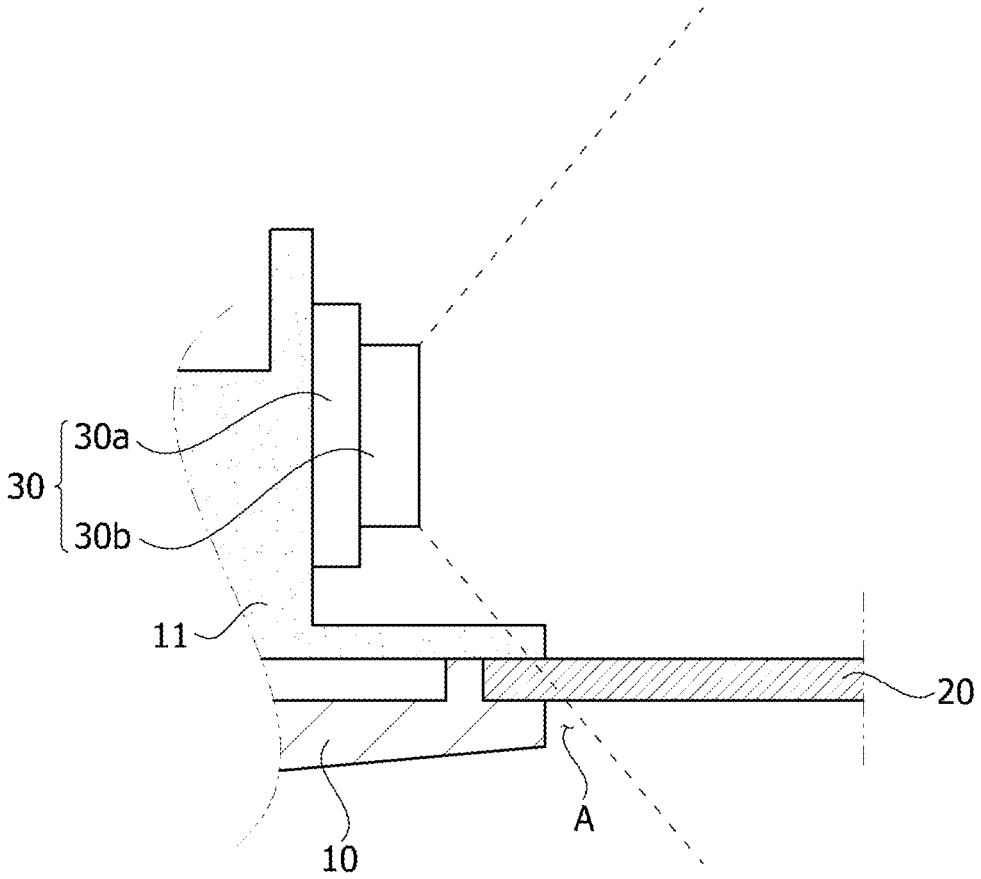
FIG. 16 is a cross-sectional view illustrating an area of a general lighting apparatus in which a shadow is formed.
Figure 17A:
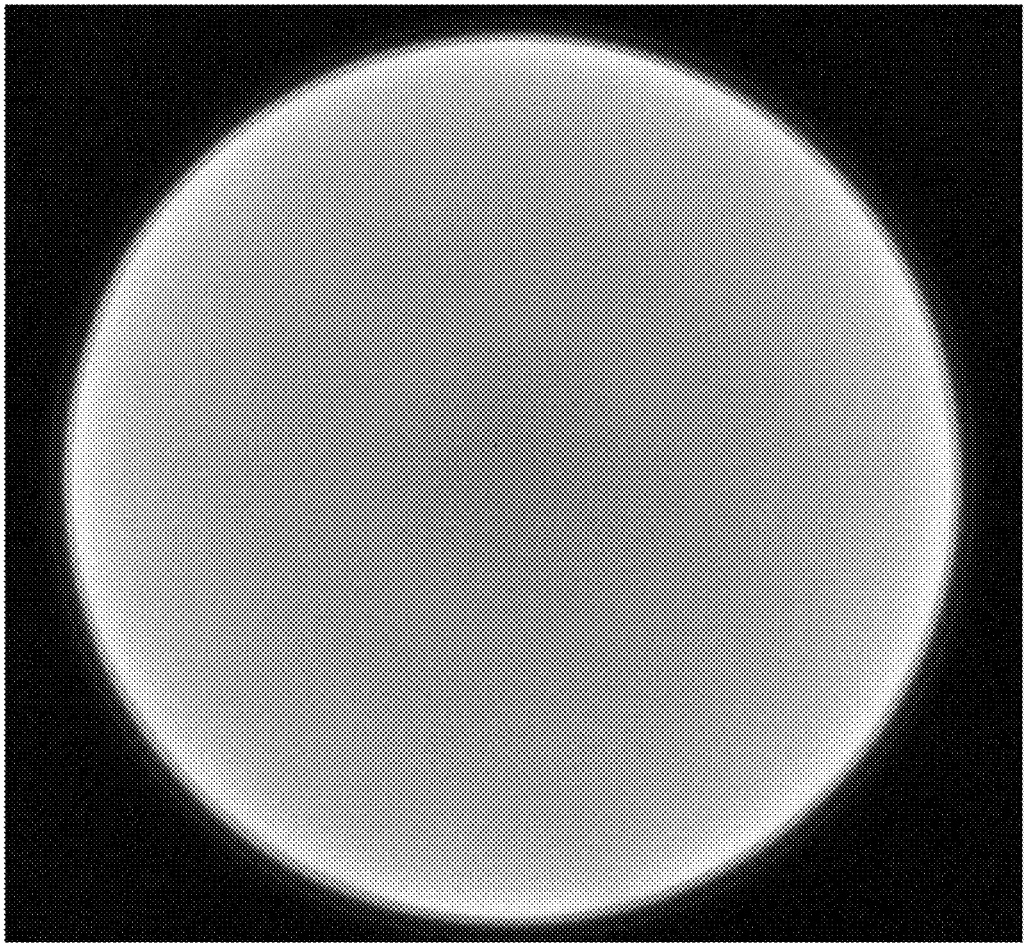
FIGS. 17A and 17B are photos of light emission of the general lighting apparatus.
Figure 17B:
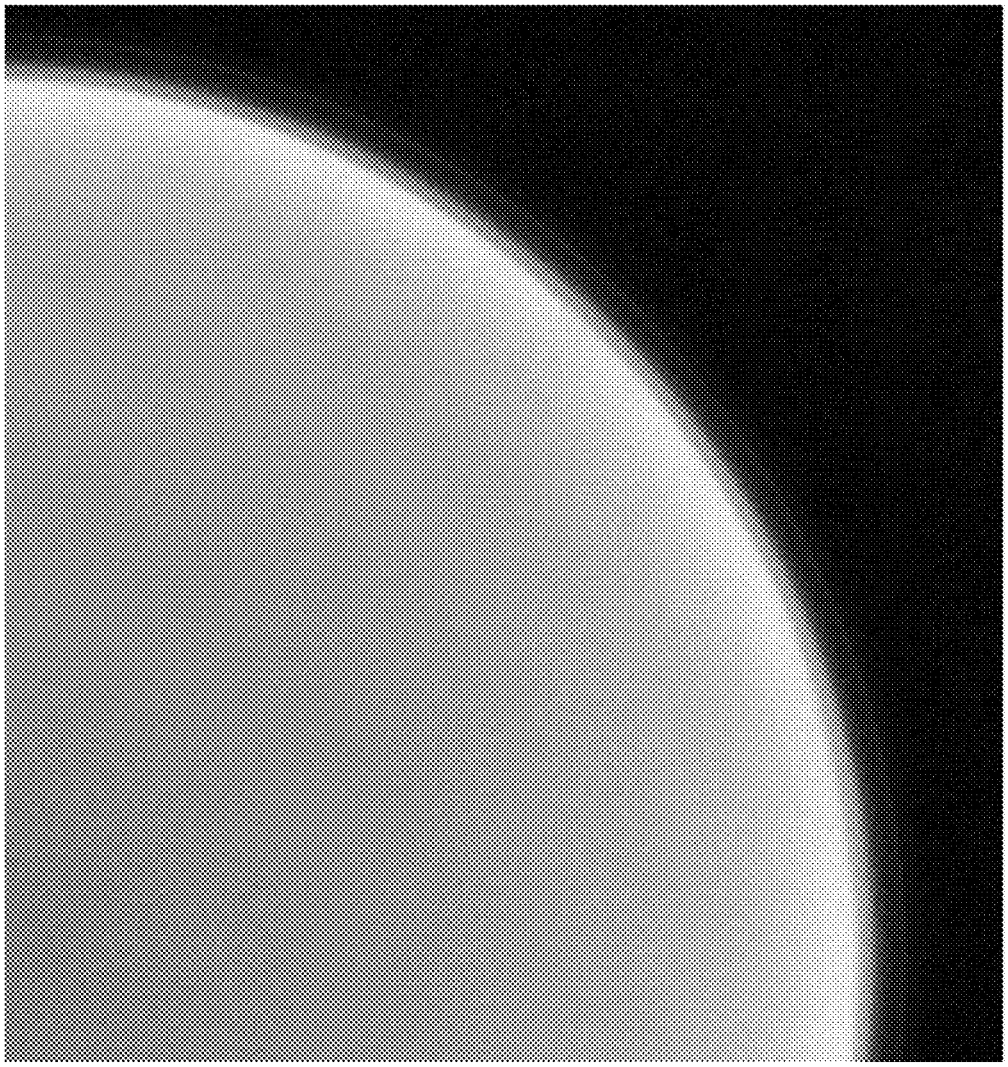

As shown in FIG. 16, light emitted from a first light source 30*b* may have a certain beam spread angle and may be emitted toward a second light source 30*b* facing the first light source 30*b*. However, a part of the light emitted from the light source 30*b* may be blocked out by a second body 11. Although light may be diffused at an optical member 20 and emitted outward, a first light of the light source 30*b* does not directly arrive at a peripheral area (area A) of the optical member 20 adjacent to an inner surface of a first body 10. Accordingly, as shown in FIGS. 17A and 17B, a band-shaped shadow may be formed in the peripheral area of the optical member 20 (refer to FIG. 16). In this case, brightness uniformity of the lighting apparatus may be decreased and quality of the lighting apparatus may be deteriorated.

Figure 15B:
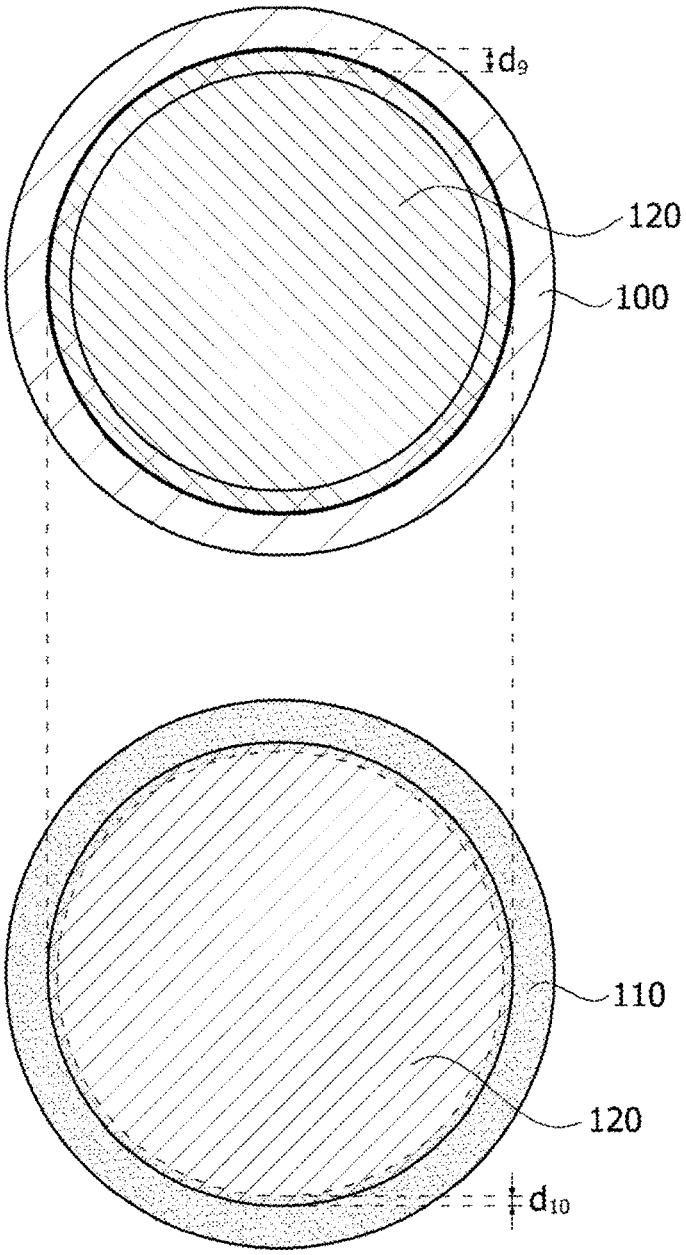
FIG. 15B is a plan view for comparing contact areas among a first body, an optical member, and a second body of FIG. 15A.

The lighting apparatus according to the embodiments of the present disclosure may prevent the limitations described above, in which the first inner circumferential surface of the first body 100 further extends to an inside of the optical member 120 than the second inner circumferential surface of the second body 110. Accordingly, as shown in FIG. 15B, since an overlap distance d9 between the optical member 120 and the first body 100 is larger than an overlap distance d10 between the optical member 120 and the second body 110, a contact area between the first body 100 and the bottom surface of the optical member 120 may be larger than a contact area between the second body 110 and the top surface of the optical member 120.

Figure 18:
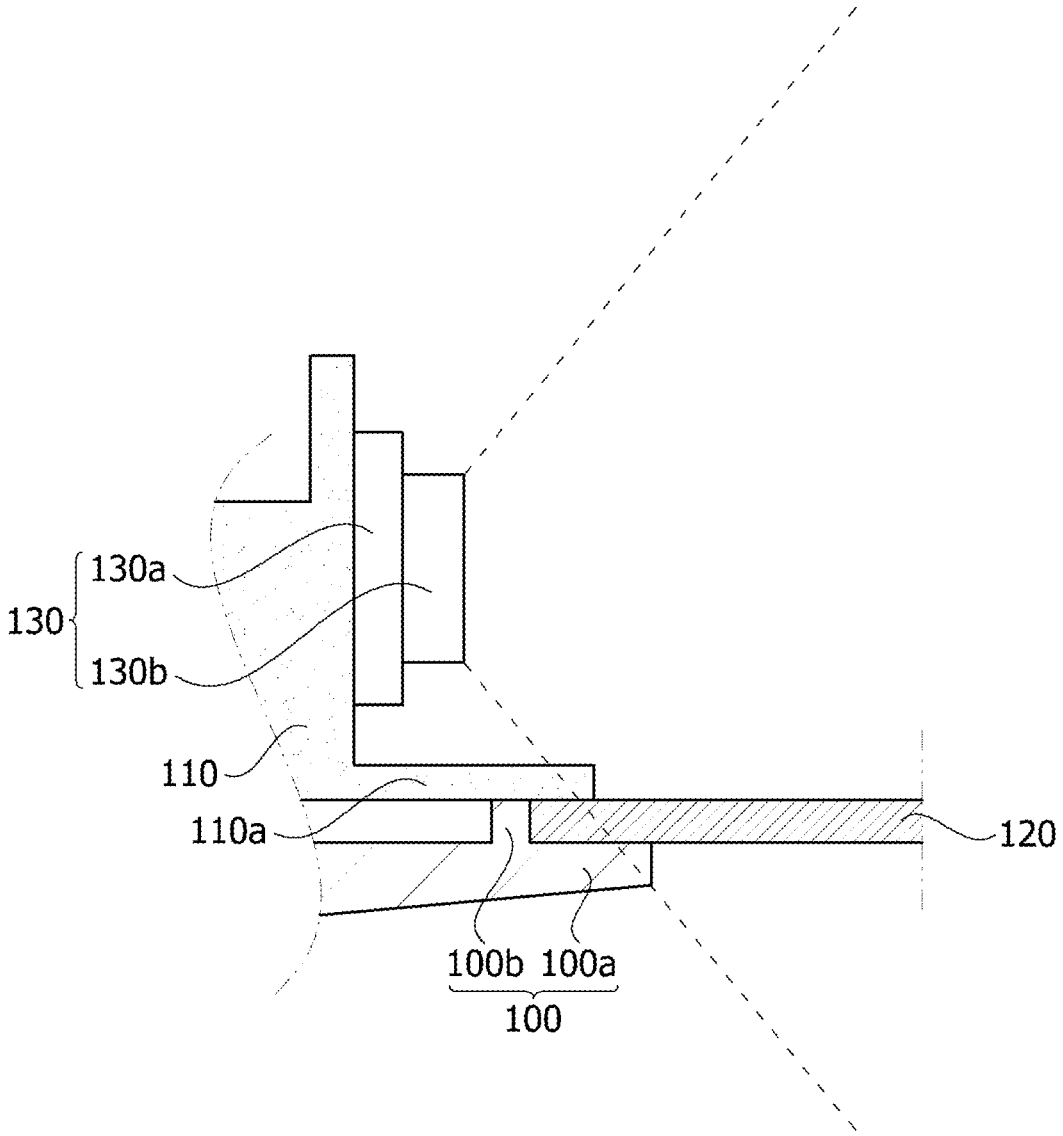
FIG. 18 is a cross-sectional view illustrating light emission of the lighting apparatus according to the embodiment.
Figure 19:
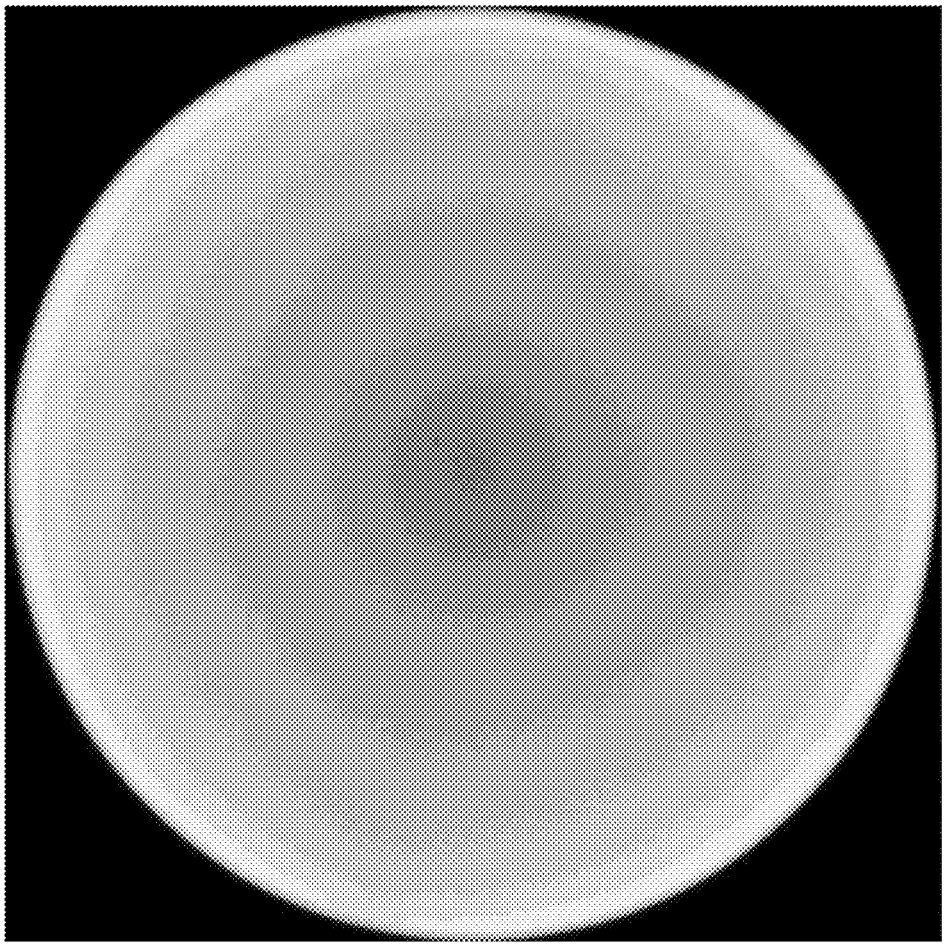
FIG. 19 is a photo of light emission of the lighting apparatus according to the embodiment.

As shown in FIG. 18, when light is emitted from the light sources 130*b*, a part of light may be blocked out by the horizontal portion 110*a* of the second body 110 in contact with the optical member 120. However, the horizontal portion 100*a* of the first body 100 in contact with the bottom surface of the optical member 120 protrudes further toward the inside of the optical member 120 than the horizontal portion 110*a* of the second body 110. Here, the horizontal portion 100*a* of the first body 100 may completely surround an area in which light is blocked out by the second body 110. Accordingly, since the first body 100 surrounds the area of the optical member 120 in which the shadow is formed, the shadow formed in the peripheral area of the optical member 120 as shown in FIG. 19 may be prevented.

Hereinafter, the overlap distance d10 between the second body 110 and the optical member 120, the overlap distance d9 between the first body 100 and the optical member 120, and a distance d between the first inner circumferential surface of the first body 100 and the second inner circumferential surface of the second body 110 will be described in detail as follows. Referring to FIG. 15A again, the second body 110 may include the horizontal portion 110*a* which protrudes parallel to the optical member 120 to partially surround the edge of the top surface of the optical member 120. When the overlap distance d10 between the horizontal portion 110*a* of the second body 110 and the top surface of the optical member 120 is too small, since the contact area between the second body 110 and the optical member 120 is reduced, the second body 110 may not completely fix the top surface of the optical member 120. Accordingly, the overlap distance d10 between the horizontal portion 110*a* of the second body 110 and the optical member 120 may be minimally 3 mm or more. The overlap distance d10 between the horizontal portion 110*a* of the second body 110 and the optical member 120 may be 5 mm.

The first body 100 may also include the horizontal portion 100*a* which protrudes parallel to the optical member 120 to support the edge of the bottom surface of the optical member 120. Here, as described above, to prevent the area of the optical member 120 in which the shadow is formed, the overlap distance d9 between the horizontal portion 100*a* of the first body 100 and the optical member 120 may be larger than the overlap distance d10 between the horizontal portion 110*a* of the second body 110 and the optical member 120. Accordingly, the contact area between the first body 100 and the bottom surface of the optical member 120 may be larger than the contact area between the second body 110 and the top surface of the optical member 120.

The distance d between the first inner circumferential surface of the first body 100 and the second inner circumferential surface of the second body 110 may be greater than a thickness t of the second inner circumferential surface of the second body 110 and may be two times or more of the thickness t of the second inner circumferential surface and 5 mm or less as shown in following Equation 1.

$$2*t \leq d \leq 5 \text{ mm} \quad \text{[Equation 1]}$$

When the distance d between the first inner circumferential surface of the first body 100 and the second inner circumferential surface of the second body 110 is too large, since the overlap distance d9 between the horizontal portion 100*a* of the first body 100 and the optical member 120 becomes too large, an area in which the first body 100 obstructs the optical member 120 may increase. Since the lighting apparatus can not obtain an appropriate light emitting area, light efficiency of the lighting apparatus may decrease. Accordingly, the distance d between the first inner circumferential surface of the first body 100 and the second inner circumferential surface of the second body 110 may be 5 mm or less.

As the thickness t of the second inner circumferential surface of the second body 110 becomes greater, the area of the optical member 120 in which the shadow is formed (refer to FIG. 17 for area A) may increase. Accordingly, the distance d between the first inner circumferential surface of the first body 100 and the second inner circumferential surface of the second body 110 may increase as the thickness t of the second inner circumferential surface of the second body 110 increases.

The distance d between the first inner circumferential surface of the first body 100 and the second inner circumferential surface of the second body 110 may be two times the thickness t of the second inner circumferential surface. For example, when the thickness t of the second inner circumferential surface of the second body 110 is 2 mm, the distance d between the first inner circumferential surface of the first body 100 and the second inner circumferential surface of the second body 110 may be 4 mm or more and 5 mm or less. Although FIG. 15A illustrates that the circuit boards 130*a* are arranged on the second body 110 to be parallel to the light emission direction Y of the optical member 120, the circuit boards 130*a* may be arranged in a structure which inclines to the light emission direction Y of the optical member 120.

Figure 20:
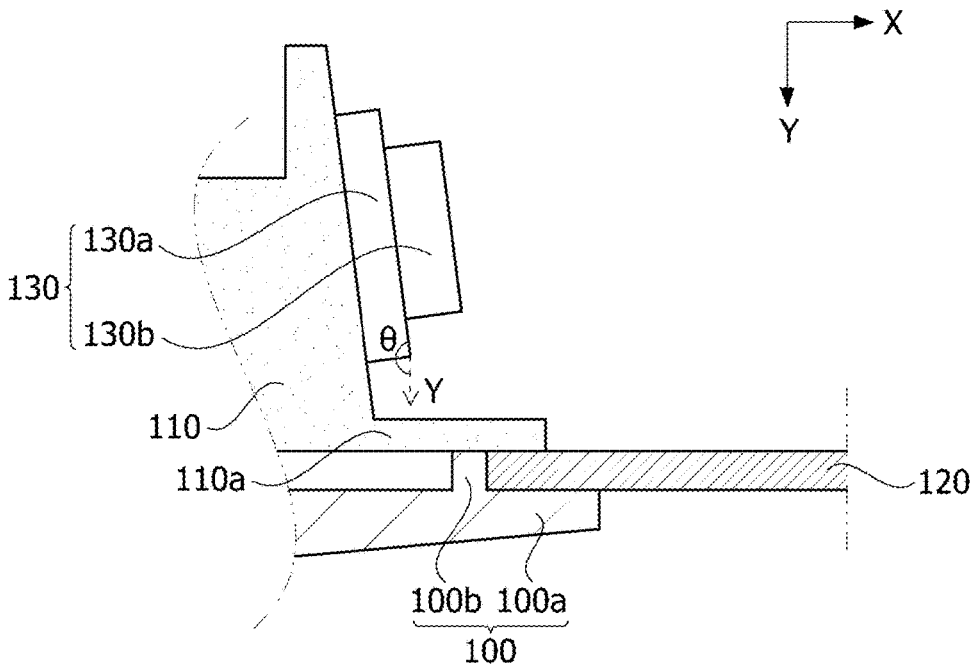
FIG. 20 is a cross-sectional view illustrating another disposition of a light source member according to the embodiment.

As shown in FIG. 20, the circuit board 130*a* may incline to the light emission direction Y of the optical member 120. Here, an angle 9 between the circuit board 130*a* and the light emission direction Y of the optical member 120 may be less than 120° and may be more than 90°.

As described above, when the optical member 120 is fixed between the first and second bodies 100 and 110 in ring shapes having an inner circumferential surface and an outer circumferential surface, the first inner circumferential surface of the first body 100 may extend further toward the inside of the optical member 120 than the second inner circumferential surface of the second body 110. A shadow formed by the first body 100 on a peripheral portion of the optical member 120 may be obstructed by the second body 110. Accordingly, since the optical member 120 exposed below the first body 100 has uniform brightness, quality of the lighting apparatus may be improved.

Figure 21A:
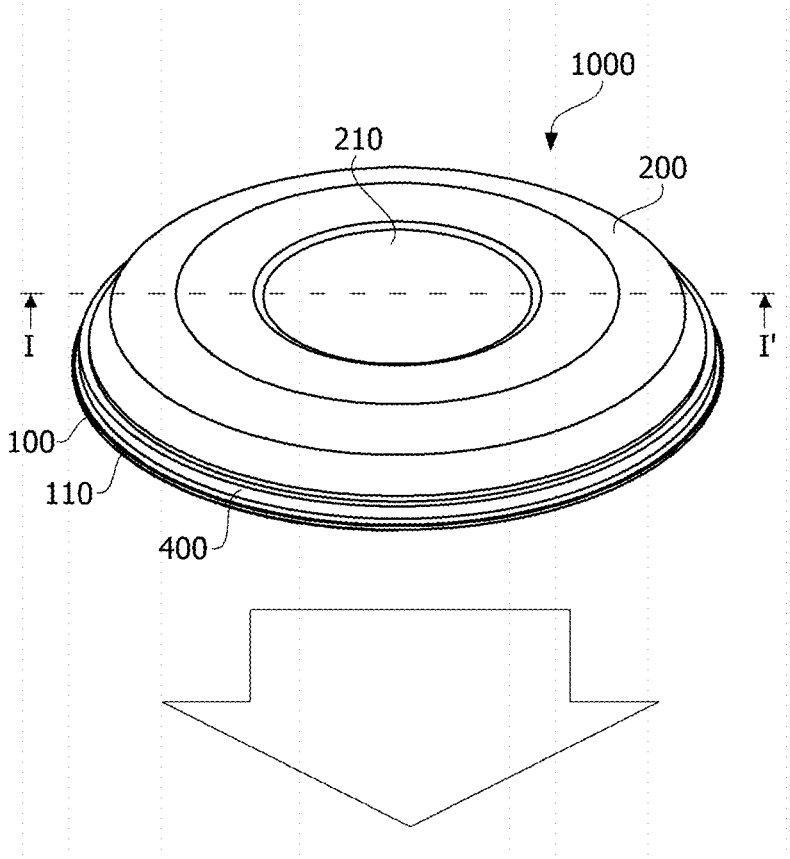
FIG. 21A is a top perspective view of a lighting apparatus according to another embodiment of the present disclosure.
Figure 21B:
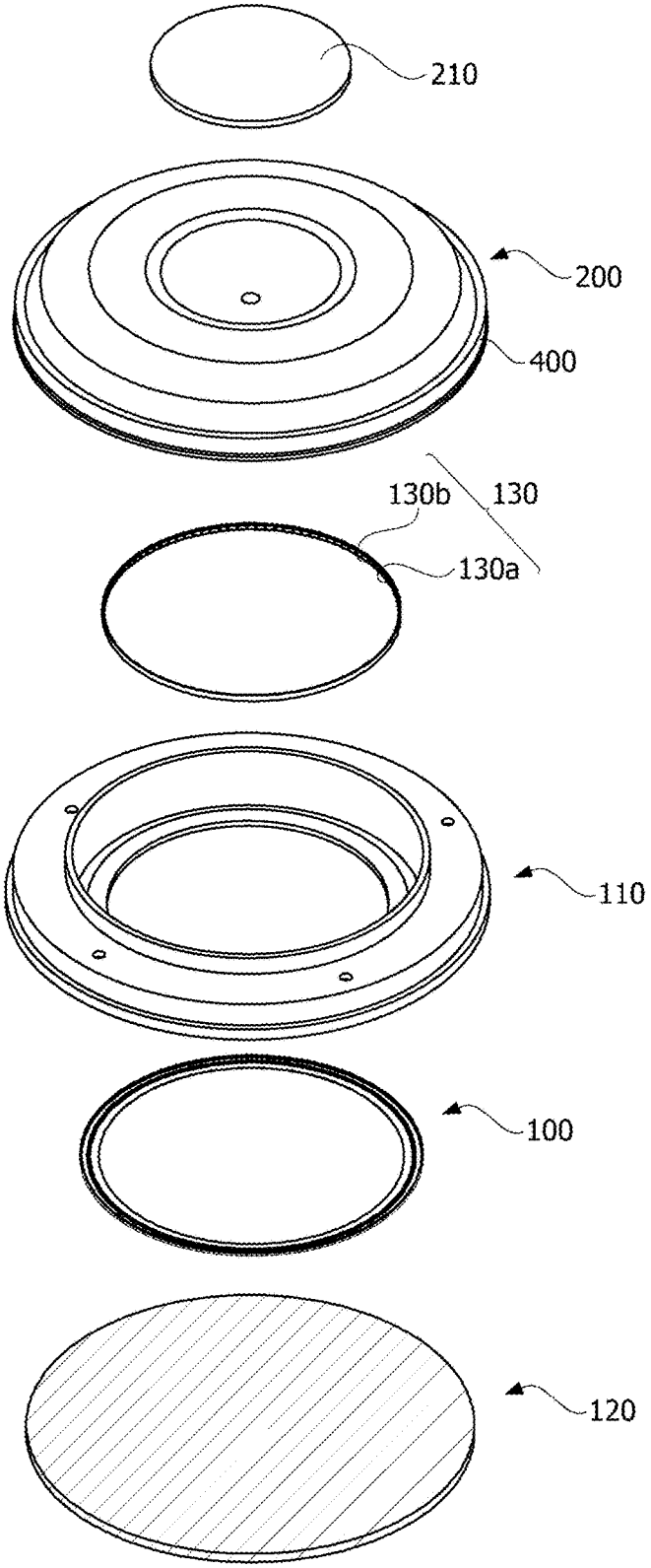
FIG. 21B is an exploded perspective view of the lighting apparatus of FIG. 21A.
Figure 22A:
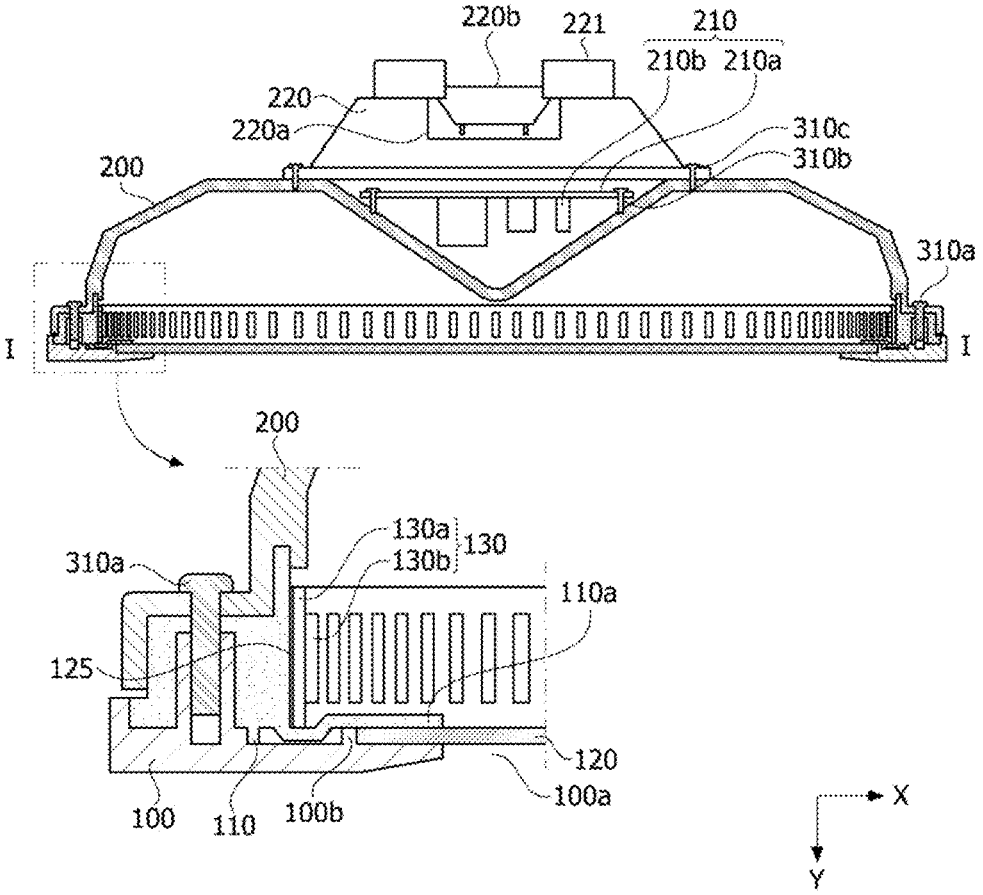
FIG. 22A is a cross-sectional view of a part taken along line I-I' of FIG. 21A, which illustrates fastening among a first body, a second body, and a cover.

As shown in FIGS. 21A, 21B, and 22A, the lighting apparatus according to another embodiment may include the first body 100 including a first inner circumferential surface and a first outer circumferential surface, the second body 110 including a second inner circumferential surface and a second outer circumferential surface, the optical member 120 provided between the first body 100 and the second body 110, the circuit board 130*a* provided on the second body 110 along an edge of the second body 110, the light source member 130 including at least two light sources 130*b* mounted on the circuit board 130*a* to face each other, the cover 200 arranged above the second body 110 and coupled with the first body 100 and the second body 110 to cover the light source member 130, and the power supply member 210 provided on the cover 200 and electrically connected to the light source member 130.

The first body 100 may be formed in a ring shape having a first inner circumferential surface and a first outer circumferential surface to have an open central portion. The first body 100 may be a plastic material and may be formed through an injection method. For example, the first body 100 may be PC. For example, the first body 100 formed of a plastic material may be lighter in weight and may be further reduced in manufacturing costs than a case in which the first body 100 is formed of a metal material. However, the material of the first body 100 is not limited thereto.

The optical member 120 may be exposed in the open central portion of the first body 100. Accordingly, light generated by the light source member 130 may be diffused by the optical member 120 exposed below the first body 100 and may be emitted outward. In the drawings, emission of light from a bottom surface of the lighting apparatus 1000 is shown.

The second body 110 may be provided on the first body 100 and may be fastened to the first body 100. The second body 110 may be formed of the same material as that of the first body 100 or the first body 100 and the second body 110 may be integrated. The first body 100 and the second body 110 may be independent components. Particularly, the second body 110 may be formed of a material with excellent heat conductance such as Al, Cu, Ag, Au, etc. to function as a heat sink.

The optical member 120 in a plate shape may be provided on the first body 100 and the second body 110. An edge of the optical member 120 may be circular or oval but is not limited thereto. For example, the shape of the optical member 120 may be easily adjusted depending on shapes of the first body 100 and the second body 110. The optical member 120 may be provided between the first body 100 and the second body 110 and may have a structure in which the edge thereof is surrounded by the first body 100 and the second body 110.

To mount the optical member 120, the first body 100 may include the horizontal portion 100*a* having a flat top surface. Also, the protruding portion 100*b* which protrudes from the horizontal portion 100*a* may be included to fix the edge of the optical member 120. An edge of a bottom surface of the optical member 120 may be mounted on the horizontal portion 100*a*, and a side surface of the optical member 120 may be in contact with the protruding portion 100*b*. Also, the second body 110 may include the horizontal portion 110*a* in contact with an edge of a top surface of the optical member 120.

The edge of the optical member 120 may be in contact between the horizontal portion 100*a* of the first body 100 and the horizontal portion 110*a* of the second body 110 in such a way that the horizontal portion 100*a* of the first body 100 and the horizontal portion 110*a* of the second body 110 may overlap with each other with the optical member 120 therebetween. The light source member 130 may be provided on an inner surface of the second body 110. The light source member 130 may include the circuit board 130*a* and at least two light sources 130*b* mounted on the circuit board 130*a*.

The circuit board 130*a* may be a PCB formed of PET, glass, PC, Si, etc. on which a plurality of such light sources 130*b* are mounted. The circuit board 130*a* may be formed in a film shape and may be selected from a single layer PCB, a multiple layer PCB, a ceramic board, a metal core PCB, etc.

The light sources 130*b* may be LED chips. The LED chip may be configured as a blue LED chip or an ultraviolet LED chip or may be configured as a package combining at least one of a red LED chip, a green LED chip, a blue LED chip, a yellow green LED chip, and a white LED chip.

The circuit board 130*a* may have a ring shape like the second body 110. The circuit board 130*a* may be in contact with the inner surface of the second body 110. An adhesive member 125 may be used to increase a contact force between the circuit board 130*a* and the second body 110. In addition, when the second body 110 functions as a heat sink, heat generated from the light source member 130 may be easily emitted through the second body 110.

In the lighting apparatus according to the embodiment described above, the circuit board 130*a* may be provided on the inner surface of the second body 110 to be parallel to a light emission direction Y of the optical member 120. Accordingly, the light sources 130*b* may emit light in a direction X perpendicular to the light emission direction Y of the optical member 120 and the light may be reflected by an inner surface of the cover 200 at least one time to proceed to the optical member 120 or the light emitted from the light sources 130*b* may be directly incident on the optical member 120.

The cover 200 may be wanted on the second body 110 to cover the light source member 130. The cover 200 may be fastened to at least one of the first body 100 and the second body 110 to surround the light source member 130.

The cover 200 may be fastened to the first and second bodies 100 and 110. The cover 200, the first body 100, and the second body 110 may be fastened using the first fastening member 310*a* such as a screw, etc. or may be adhered using an adhesive member but are not limited thereto. The first fastening member 310*a* may couple the cover 200, the first body 100, and the second body 110 at an edge of the lighting apparatus.

The cover 200 may be formed of a material with high reflectance to reflect light emitted from the light source member 130 to the optical member 120. For example, the cover 200 may include white silicone such as phenyl silicone and methyl silicone and may have a structure which further includes reflecting particles in addition to the white silicone to increase reflectance. For example, the cover 200 may be glass in which TiO2 is distributed but is not limited thereto. The inner surface of the cover 200 described above may diffusely reflect the light emitted from the light source member 130 and may reflect light incident on the cover 200 to the optical member 120 in Lambertian distribution.

The cover 200 may be formed of a material such as glass, plastic, PP, PE, PC, etc. and a material which reflects light such as Ag, Al, etc. may be additionally applied, printed, or attached, as a film type, to or may additionally coat the inner surface of the cover 200. The cover 200 is not limited thereto but may include various materials.

The cover 200 may have a concave area corresponding to a central portion of the optical member 120 but is not limited thereto. For example, when the cover 200 includes the concave area as shown in the drawings, the power supply member 210 for driving the light source member 130, etc. may be further provided in the concave area of the cover 200.

The power supply member 210 may change external power supplied from the outside into power necessary for the light source member 130 to provide to the light source member 130. The power supply member 210 may be provided on an outer surface of the cover 200 and may be located in the concave portion of the cover 200. The power supply member 210 may be fixed to the outer surface of the cover 200 through a second fastening member 310*b*.

The power supply member 210 may include a supporting board 210*a* and a plurality of components 210*b* arranged on the supporting board 210*a*. For example, the plurality of components 210*b* may include a direct current (DC) converter which converts alternating current (AC) power provided form an external power source into DC power, a driving chip which controls driving of the light source member 130, an electrostatic discharge (ESD) protector for protecting the light source member 130, etc. but is not limited thereto.

A fixing member 220 to fix the lighting apparatus 1000 to a ceiling, etc. may be further provided on the power supply member 210. The fixing member 220 may be located on the cover 200 to cover the power supply member 210. The fixing member 220 may be fixed to the outer surface of the cover 200 through a third fastening member 310*c*.

The fixing member 220 may include a groove 220*a* formed at a top surface. The groove 220*a* may accommodate a socket electrically connected to the power supply member 210 to supply external power to the power supply member 210. Also, to easily accommodate the socket in the groove 220*a*, a socket guide 220*b* that guides the socket in the groove 220*a* may be further provided.

The buffering member 221, etc. may be further provided on the fixing member 220. The fixing member 220 may relieve a shock when the lighting apparatus 1000 is fixed to a ceiling and increase a contact force of the lighting apparatus 1000 to fix the lighting apparatus 1000 to the ceiling not to rotate left and right.

However, the power supply member 210 may be located outside the cover 200 and the light source member 130 may be located in the lighting apparatus surrounded by the first body 100, the second body 110, the cover 200, and the optical member 120. Accordingly, the power supply member 210 and the light source member 130 may be electrically connected through a connecting member which passes through the cover 200.

When the connecting member connects the power supply member 210 with the light source member 130 in the cover 200, an arm portion may be partially generated by the connecting member at the optical member 120. Particularly, light emitted by the light source member 130 may be absorbed by the connecting member, thereby decreasing light efficiency of the lighting apparatus. To prevent it, the connecting member may be arranged on the outer surface of the cover 200. However, in this case, the connecting member may be directly exposed outside the lighting apparatus 1000 and reliability may be decreased.

A groove may be formed at the inner surface of the cover 200 and the connecting member may be inserted in the groove. Accordingly, the connecting member may not be exposed at the inner surface of the cover 200.

Figure 22B:
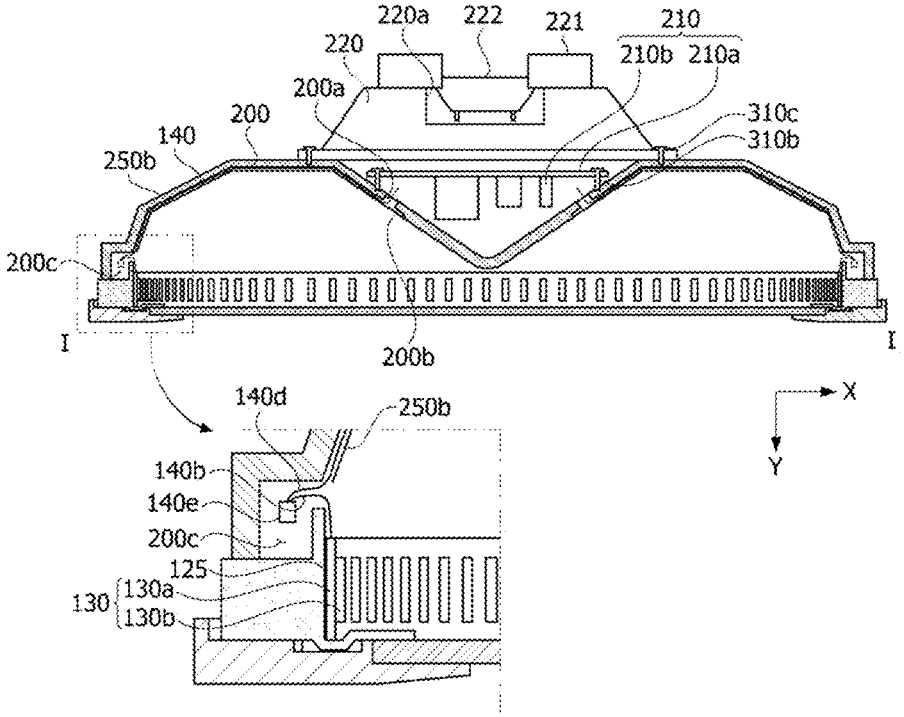
FIG. 22B is a cross-sectional view of the part taken along line Id of FIG. 21A, which illustrates connection between a power supply member and a light source member.
Figure 23:
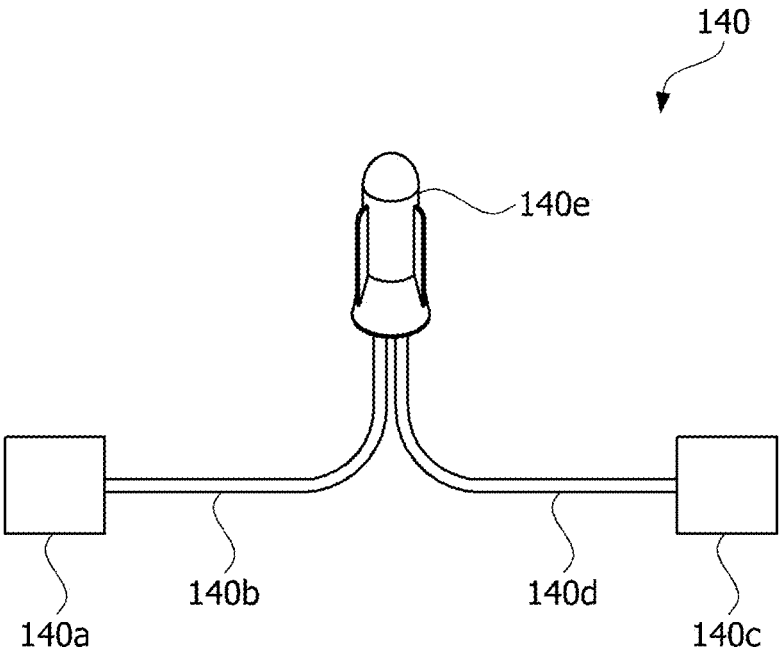
FIG. 23 is a cross-sectional view of a connecting member according to embodiments of the present disclosure.

Hereinafter, an electrical connection structure between the power supply member 210 and the light source member 130 through the connecting member will be described in detail as follows. As shown in FIG. 23, a connecting member 140 may include a first fastening portion 140*a* fastened to the light source member 130, a first wire 140*b* which extends from the first fastening portion 140*a*, a second fastening portion 140*c* electrically connected to the power supply member 210, a second wire 140*d* which extends from the second fastening portion 140*c*, and a third fastening portion 140*e* which connects the first and second wires 140*b* and 140*d*. Shapes of the first, second, and third fastening portions 140*a*, 140*c*, and 140*e* are not limited thereto and easily changeable. The second wire 140*d* may be inserted in a first groove 200*b* formed at the inner surface of the cover 200 and may extend to an edge of the cover 200, as shown in FIG. 22B.

Since the power supply member 210 is provided outside the cover 200 and the light source member 130 is provided in the cover 200, the cover 200 may include a hole 200*a* through which the connecting member 140 may pass. At least one hole 200*a* may be formed. When there are two of such holes 200*a*, there may be two of such connecting members 140.

The connecting member 140 inserted in the cover 200 through the hole 200*a* may extend to the edge of the cover 200 along the first groove 200*b* formed at the inner surface of the cover 200. The first groove 200*b* may include a peripheral portion of the hole 200*a*. Specifically, the hole 200*a* may be formed in the first groove 200*b*. Also, a second groove 200*c* which accommodates the connecting member 140 may be formed at the edge of the cover 200.

The second groove 200*c* may protrude from the edge of the cover 200 toward the outside of the lighting apparatus 1000. Also, the first and second wires 140*b* and 140*d* and the third fastening portion 140*e* may be accommodated in the second groove 200*c*.

Figure 24:
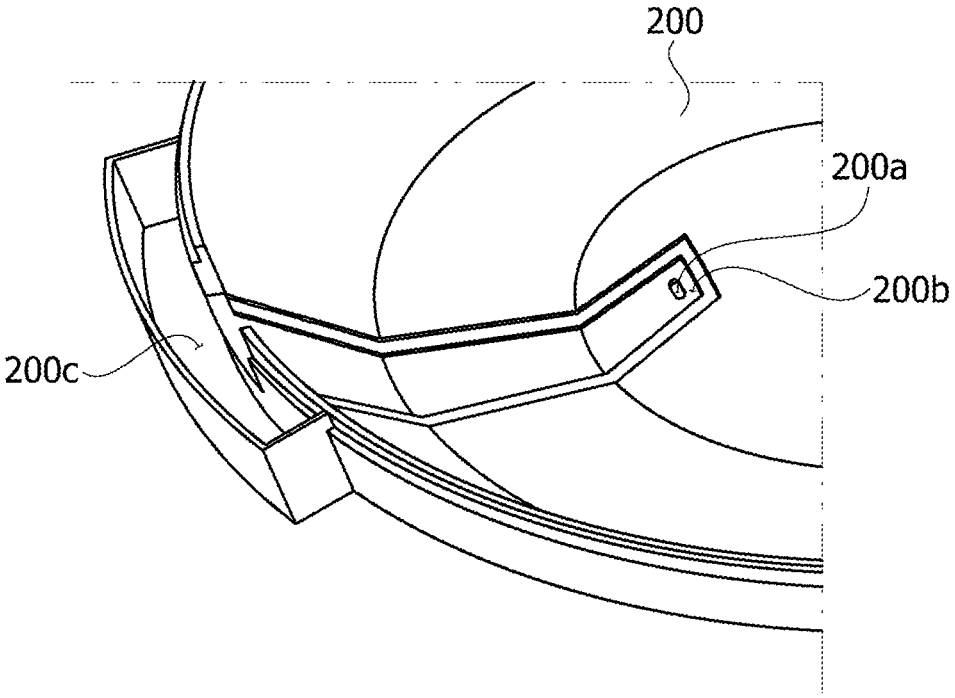
FIG. 24 is a perspective view illustrating an inner surface of the cover.

Hereinafter, the inner surface of the cover 200 at which the first groove 200*b* and the second groove 200*c* are formed and a method of accommodating the connecting member 140 at the inner surface of the cover 200 will be described in detail as follows. As shown in FIG. 24, at least one hole 200*a* may be formed at the inner surface of the cover 200 and the hole 200*a* may pass through the cover 200. Here, a diameter of the hole 200*a* may be easily changeable. For example, when the connecting member 140 includes a wire, the diameter of the hole 200*a* may be adjustable according to a diameter of the wire.

The first groove 200*b* may be formed at the inner surface of the cover 200 to include the hole 200*a*. The first groove 200*b* may extend to the edge of the cover 200. Since the first groove 200*b* has a step at an edge, when a second reflecting member 250*b* is fixed to cover the first groove 200*b*, a step between the second reflecting member 250*b* and the inner surface of the cover 200 may be compensated.

The second groove 200*c* may be formed at the edge of the cover 200 to protrude outward from the cover 200. The second groove 200*c* may be connected to the first groove 200*b* in such a way that the connecting member 140 which extends along the first groove 200*b* may be accommodated in the second groove 200*c*.

Figure 25A:
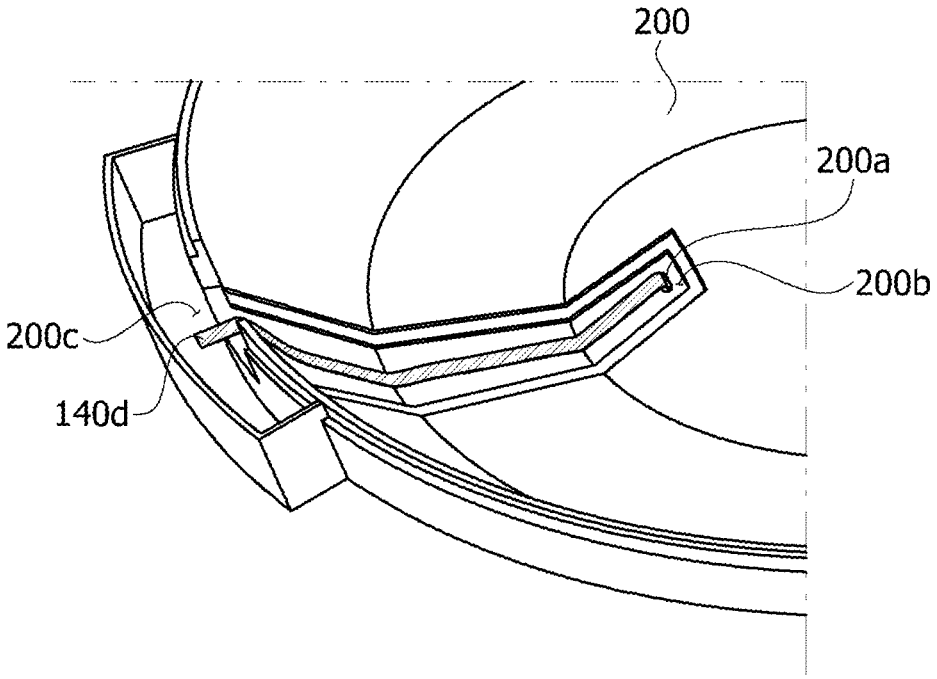
FIGS. 25A and 25B are perspective views illustrating a method of inserting the connecting member.

As shown in FIG. 25A, the second wire 140*d* connected to the power supply member 210 (refer to FIG. 22B) provided outside the cover 200 may be inserted in the hole 200*a* and may protrude to the inner surface of the cover 200. Also, the second wire 140*d* which protrudes may extend to the edge of the cover 200 along the first groove 200*b* and may be accommodated in the second groove 200*c* of the cover 200.

Figure 25B:
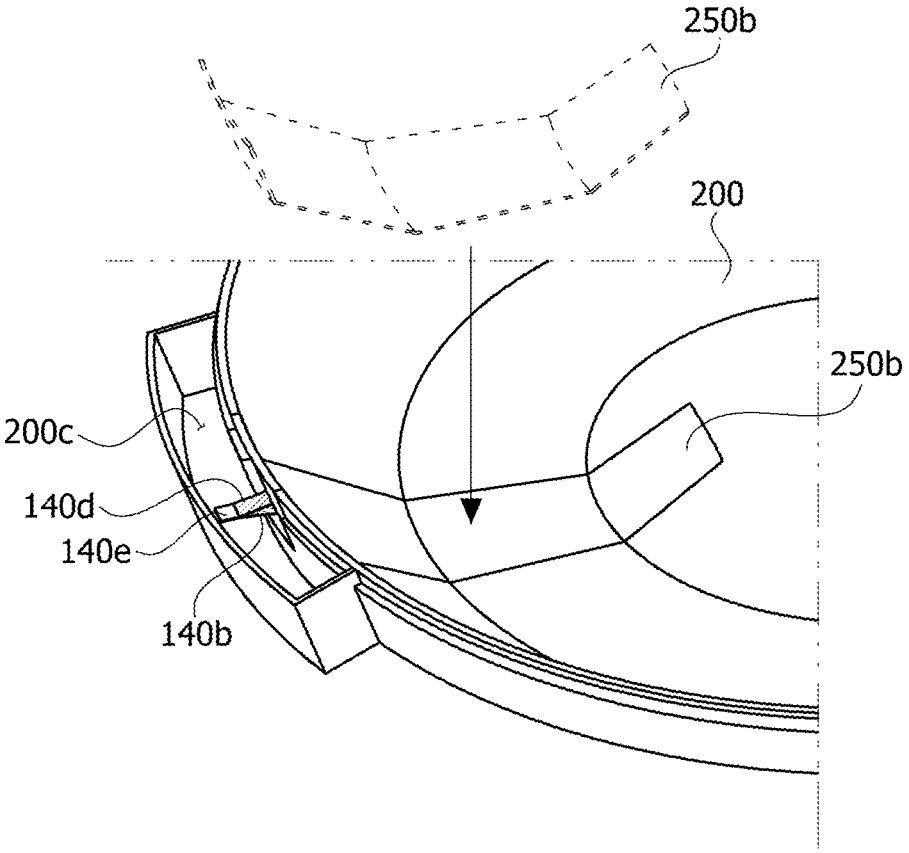
Figure 26A:
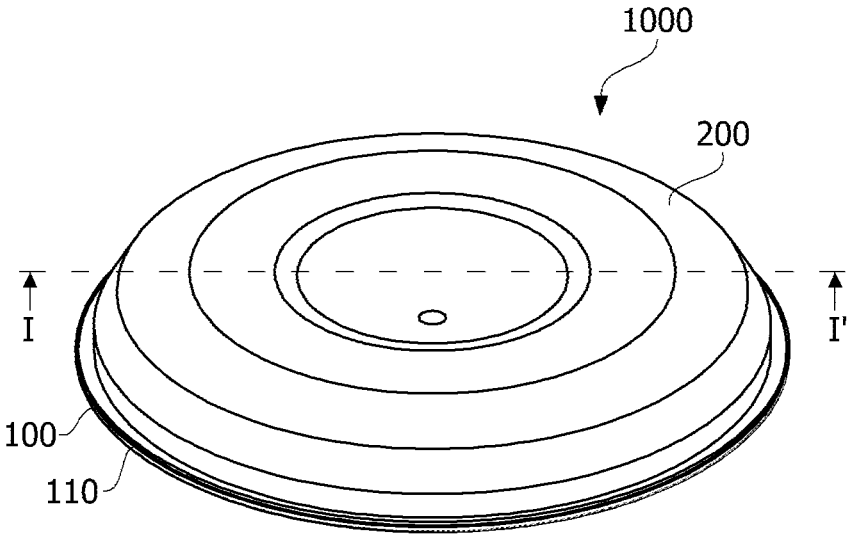
FIG. 26A is a top perspective view of a lighting apparatus according to another embodiment of the present disclosure.
Figure 26B:
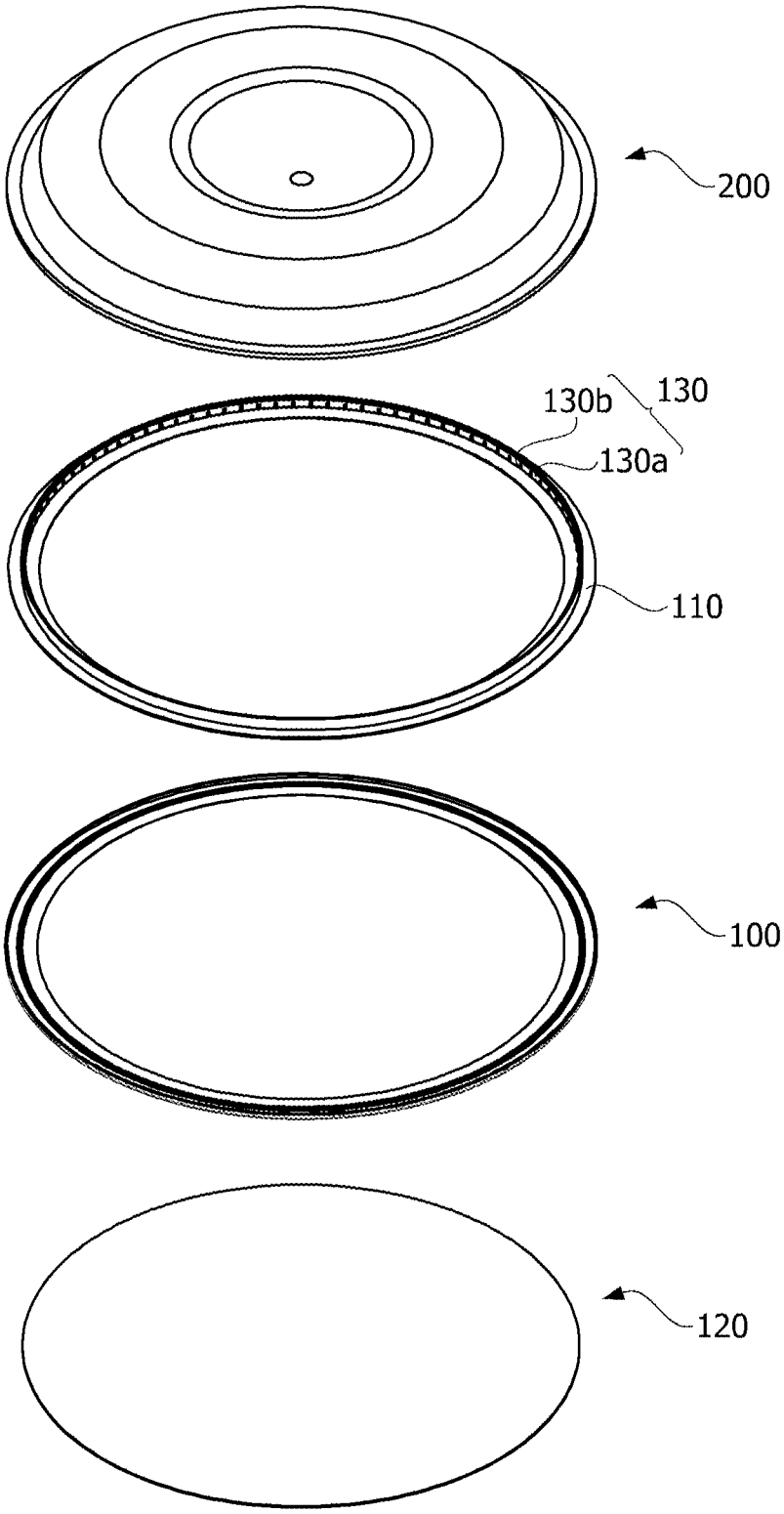
FIG. 26B is an exploded perspective view of the lighting apparatus of FIG. 26A.
Figure 27:
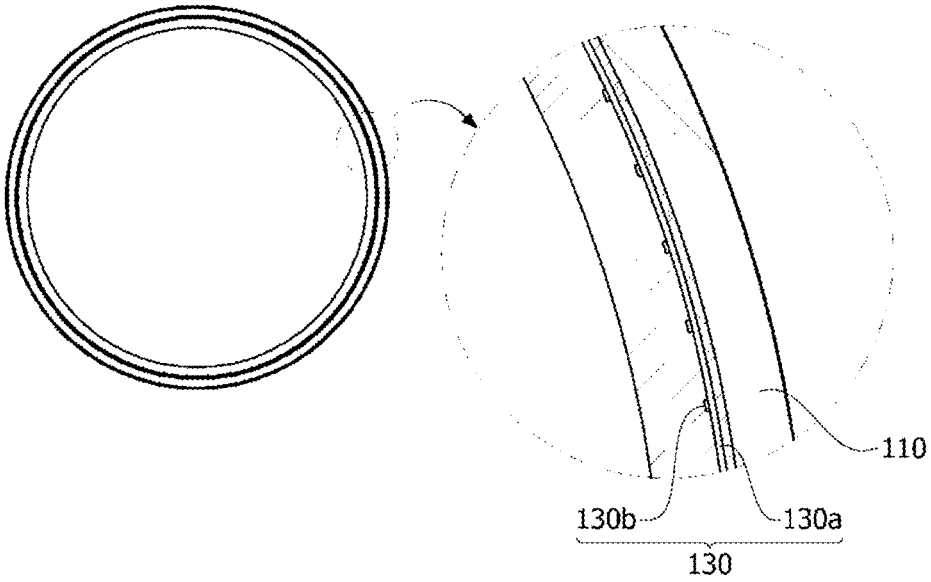
FIG. 27 is a plan view illustrating a second body and a light source member.
Figure 28:
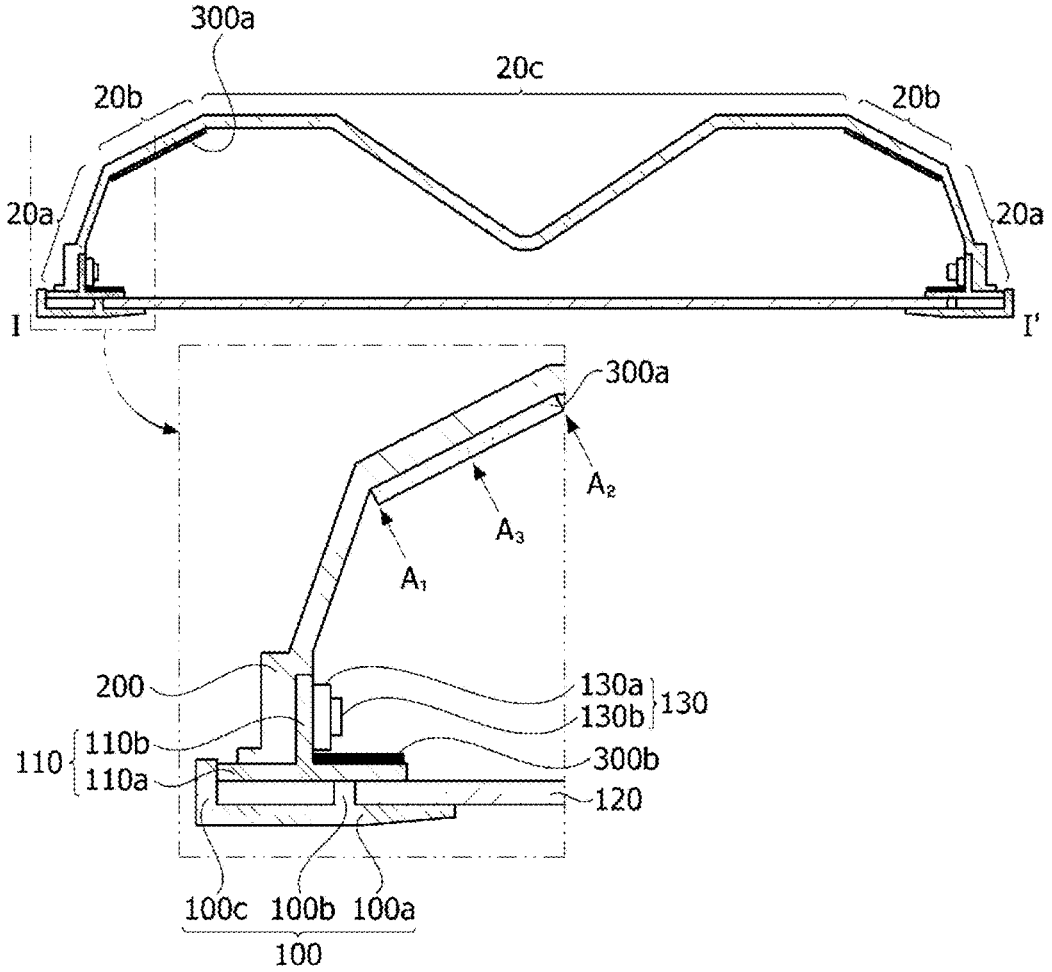
FIG. 28 is a cross-sectional view illustrating a part taken along line I-I' of FIG. 26A.

Also, as shown in FIG. 25B, the first wire 140*b* connected to the light source member 130 through the first fastening portion 140*a* (refer to FIG. 23) may also extend to the second groove 200*c*. Accordingly, the first wire 140*b* and the second wire 140*d* may be electrically connected in the second groove 200*c*. The first and second wires 140*b* and 140*d* may be electrically connected through the third fastening portion 140*e*, and the third fastening portion 140*e* may be accommodated in the second groove 200*c*. Accordingly, in the lighting apparatus according to the embodiment of the present disclosure, the third fastening portion 140*e* may be prevented from interfering with a path of light generated by the light source member 130 by preventing the third fastening portion 140*e* from being exposed at the inner surface of the cover 200.

The second reflecting member 250*b* may cover the first groove 200*b* formed at the inner surface of the cover 200. The second reflecting member 250*b* may include PET including a reflecting material such as Ag, Al, etc.

The second reflecting member 250*b* may be attached to the inner surface of the cover 200 using an adhesive member, and an edge of the second reflecting member 250*b* may correspond to an edge of the first groove 200*b* in such a way that the second reflecting member 250*b* may be inserted in the first groove 200*b*. As described above, since the first groove 200*b* has a step at the edge, the step between the second reflecting member 250*b* inserted in and fixed to the first groove 200*b* and the inner surface of the cover 200 may be compensated.

In the lighting apparatus according to the embodiment of the present disclosure described above, the connecting member 140 which passes through the cover 200 may electrically connect the power supply member 210 provided outside the cover 200 with the light source member 130 provided in the cover 200. In the connecting member 140, the second wire 140*d* connected to the power supply member 210 may be inserted in the cover 200 through the hole 200*a* formed in the cover 200 and may extend to the edge of the cover 200 along the first groove 200*b* formed at the inner surface of the cover 200. Also, the first wire 140*b* connected to the light source member 130 may also extend to the edge of the cover 200 and may be fastened to the second wire 140*d* at the second groove 200*c* which protrudes from the edge of the cover 200.

Accordingly, the partial arm portion generated at the optical member 120 may be removed by removing light interference caused by the connecting member 140. Accordingly, quality of the lighting apparatus may be increased by improving brightness uniformity.

As shown in FIGS. 26A, 26B, 27, and 28, the lighting apparatus 1000 according to another embodiment may include the first body 100 including an inner circumferential surface and an outer circumferential surface, the second body 110 including the horizontal portion 110*a* which is located on the first body 100 along an edge of the first body 100 and includes an inner circumferential surface and an outer circumferential surface and a vertical portion 110*b* protruding from the horizontal portion 110*a*, the optical member 120 arranged between the first body 100 and the second body 110, the light source member 130 including the circuit board 130*a* located on an inner surface of the vertical portion 110*b* along the vertical portion 110*b* of the second body 110 and at least two light sources 130*b* mounted on the circuit board 130*a* to face each other, and the cover 200 fastened to at least one of the first body 100 and the second body 110 to surround the light source member 130 and having an inner surface on which a third reflecting member 300*a* is provided.

The first body 100 may be formed in a ring shape having the inner circumferential surface and the outer circumferential surface to have an open central portion. The optical member 120 may be exposed at the open central portion of the first body 100. Light generated at the light source member 130 may be diffused through the optical member 120 and may be emitted outward. For example, the optical member 120 may be a light guide plate. When the optical member 120 is a light guide plate, the optical member 120 may convert a linear light source output from the light source member 130 into a surface light source and may emit the surface light source outward.

The optical member 120 may have a plate shape with a circular or oval edge. The edge of the optical member 120 may be inserted between the first body 100 and the second body 110, and the optical member 120 may be fixed between the first body 100 and the second body 110. In detail, the first body 100 may include the protruding portion 100*b* which protrudes from the horizontal portion 100*a* of the first body 100 and a side surface of the optical member 120 may be fixed to the protruding portion 100*b*. Particularly, the edge of the first body 100 may further include a bent portion 100*c* bent toward a top surface. In this case, a side surface of the second body 110 may be surrounded by the bent portion 100*c* of the first body 100 and the second body 110 may be fixed to the first body 100.

The second body 110 may be provided on the first body 100, the side surface of the second body 110 may be supported by the bent portion 100*c* of the first body 100, and a bottom surface of the second body 110 may be supported by the protruding portion 100*b* of the first body 100 and the optical member 120. The second body 110 may include the horizontal portion 110*a* surrounded by the bent portion 100*c* of the first body 100 and the vertical portion 110*b* protruding from the horizontal portion 110*a*. The second body 110 may be provided on the first body 100 to allow the horizontal portion 110*a* to cover a part of a top surface of the optical member 120.

The second body 110 may be formed of the same material as that of the first body 100. The first body 100 and the second body 110 may be integrated. Particularly, when the second body 110 is formed of a material with excellent heat conductance such as Al, Cu, Ag, Au, etc., the second body 110 may function as a heat sink.

The light source member 130 may be located on an inner surface of the vertical portion 110*b* of the second body 110. The light source member 130 may include the circuit board 130*a* and at least two light sources 130*b* mounted on the circuit board 130*a*. The circuit board 130*a* may be supported by the vertical portion 110*b* of the second body 110 and may be in contact with the inner surface of the vertical portion 110*b*. Accordingly, heat generated at the light source member 130 may be easily discharged through the second body 110.

The circuit board 130*a* may be a PCB formed of polyethylene terephthalate (PET), glass, PC, Si, etc. on which a plurality of such light sources 130*b* may be mounted and may be formed in a film shape. Also, the circuit board 130*a* may be selected from a single layer PCB, a multiple layer PCB, a ceramic board, a metal core PCB, etc.

At least two light sources 130*b* may be mounted on the circuit board 130*a*, and the light sources 130*b* may be mounted on the circuit board 130*a* to face each other. The light sources 130*b* may be LED chips. The LED chip may be configured as a blue LED chip or an ultraviolet LED chip or may be configured as a package combining at least one of a red LED chip, a green LED chip, a blue LED chip, a yellow green LED chip, and a white LED chip.

The cover 200 may be provided on the second body 110 to cover the light source member 130 described above. The cover 200 may be fastened to at least one of the first body 100 and the second body 110 to surround the light source member 130. The cover 200 may be fastened to the second body 110. The cover 200 and the first and second bodies 100 and 110 may be fastened using a fastening member such as a screw, etc, or may be adhered using an adhesive member but are not limited thereto.

The cover 200 may be formed of a material with high reflectance to reflect light emitted from the light source member 130 to the optical member 120. For example, the cover 200 may include white silicone such as phenyl silicone and methyl silicone and may have a structure which further includes reflecting particles in addition to the white silicone to increase reflectance. For example, the cover 200 may be glass in which TiO2 is distributed but is not limited thereto. The inner surface of the cover 200 described above may diffusely reflect the light emitted from the light source member 130 and may reflect light incident on the cover 200 to the optical member 120 in Lambertian distribution.

The cover 200 may include a first area 20*a* extending from the second body 110, a second area 20*b* extending from the first area 20*a*, and another area extending from the second area 20*b* to the center of the lighting apparatus. Here, the other area may include a flat portion parallel to the optical member 120 and a concave portion of the center of the cover 200. A power supply portion for driving the light source member 130 may be further provided above the concave portion of the cover 200.

Generally, a first light which is emitted from the light source 130*b* and directly proceeds to the optical member 120 and a second light which is reflected by the inner surface of the cover 200 at least one time and proceeds to the optical member 120 may be incident on the optical member 120. As described above, since the inner surface of the cover 200 diffusely reflects light emitted from the light source 130*b*, the second light incident on the optical member 120 may be identical in the whole area of the optical member 120.

However, since the intensity of the first light is generally reduced as farther away from the light sources 130*b*, a brightness degree of a central portion may be relatively lower than that of a peripheral portion in a general lighting apparatus. Accordingly, since the general lighting apparatus has a great brightness difference between an area overlapping with the light source and an area not overlapping the light source, a bright line occurs in the lighting apparatus.

In the lighting apparatus according to the embodiment of the present disclosure, it may be possible to prevent the light emitted from the light sources 130*b* from being concentrated on a particular area of the optical member 120, for example, the peripheral portion of the lighting apparatus on which the light sources 130*b* are arranged. For this, in the embodiment of the present disclosure, the third reflecting member 300*a* for specular reflection may be provided on the inner surface of the cover 200 in such a way that the intensity of the second light may differ for each area of the optical member 120.

The third reflecting member 300*a* may include one end A1 in contact with the first area 20*a*, another end A2 in contact with a third area 20*c*, and a center A3 between the one end A1 and the other end A2. That is, the third reflecting member 300*a* may be disposed in front of an inner surface of the second area 20*b* of the cover 200.

Figure 29A:
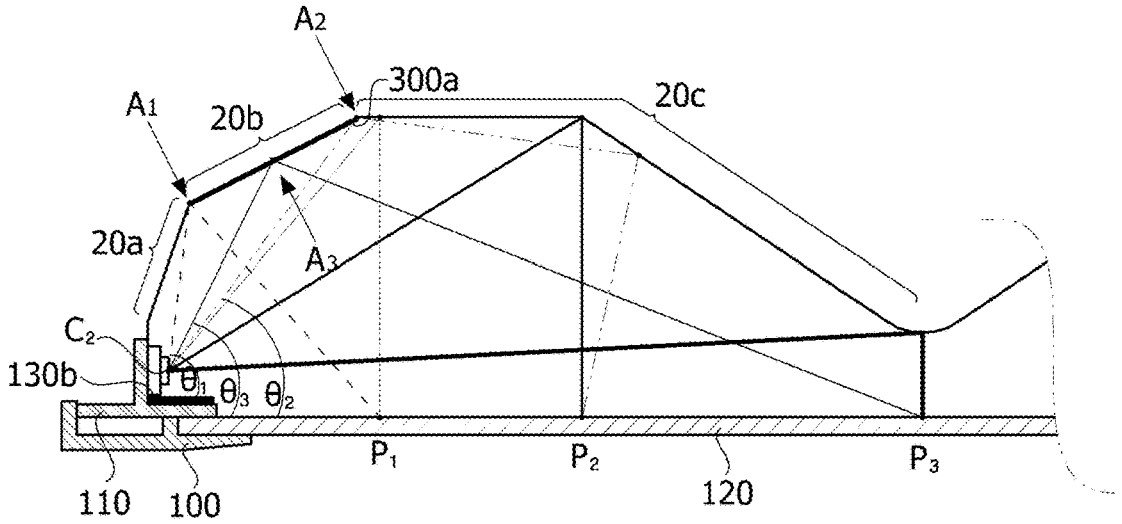
FIG. 29A is a cross-sectional view illustrating light reflected by a first reflecting member of FIG. 28.
Figure 29B:
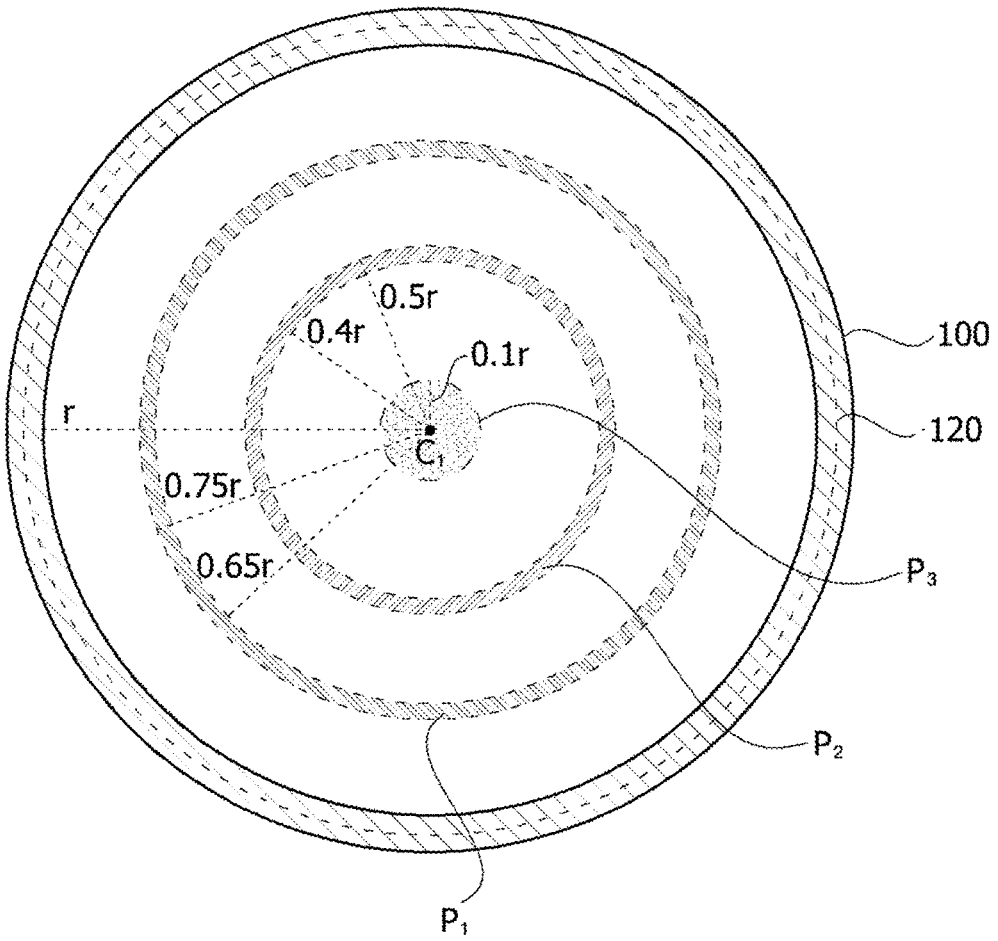
FIG. 29B is a plan view illustrating positions of P1, P2, and P3 of FIG. 29A.

Hereinafter, light reflection of the third reflecting member 300*a* will be described in detail as follows. As shown in FIGS. 29A and 29B, the second area 20*b* of the cover 200 may incline to allow light to easily proceed toward the central portion of the lighting apparatus through the third reflecting member 300*a*. When the third reflecting member 300*a* is a film including metal with high reflectance such as Ag, Al, Au, etc., light incident on the third reflecting member 300*a* may be specularly reflected by the surface of the third reflecting member 300*a* and may proceed to the optical member 120.

A first angle θ1 between an imaginary line which connects the one end A1 of the third reflecting member 300*a* and a center $C_2$ of a light emission surface of the light source 130*b* and the top surface of the optical member 120 may be 70° to 75°. As described above, since the third reflecting member 300*a* specularly reflects incident light, as the first angle θ1 becomes smaller, the light reflected by the third reflecting member 300*a* may be reflected toward the edge of the optical member 120 adjacent to the light source 130*b*. In this case, brightness at the edge of the optical member 120 becomes higher in such a way that a brightness difference between the edge and the central portion of the optical member 120 may increase. Accordingly, the first angle θ1 may be 70° to 75° but is not limited thereto.

A second angle θ2 between an imaginary line which connects another end of a fourth reflecting member 300*b* with the center $C_2$ of the light emission surface of the light source 130*b* and the top surface of the optical member 120 may be smaller than the first angle θ1. For example, the second angle θ2 may be 35° to 40° but is not limited thereto. A third angle θ3 between an imaginary line which connects the center A3 of the fourth reflecting member 300*b* with the center $C_2$ of the light emission surface of the light source 130*b* and the top surface of the optical member 120 may be between the first angle θ1 and the second angle θ2. For example, the third angle θ3 may be 45° to 50° but is not limited thereto.

Some beams of light generated at the light sources 130*b*, which have the first angle θ1 and proceed to the third reflecting member 300*a*, may be reflected by the one end of the third reflecting member 300*a* and may arrive at a first position P1 of the optical member 120. The first position P1 may be identical to an area in which light reflected by a flat portion of the third area 20*c* of the cover 200 proceeds to the optical member 120.

Also, light among lights generated at the light sources 130*b*, which has the second angle θ2 and proceeds to the third reflecting member 300*a*, may be reflected by the other end of the third reflecting member 300*a* and may arrive at a second position P2 of the optical member 120. The light which has the second angle θ2 and proceeds to the third reflecting member 300*a* may be reflected to the concave portion of the cover 200 and reflected again by the concave portion and may arrive at the position P2 of the optical member 120. The second position P2 may be identical to an area in which light reflected by a boundary of a flat portion and a concave portion of the third area 20*c* of the cover 200 proceeds to the optical member 120.

Also, light among lights generated at the light sources 130*b*, which has the third angle θ3 and proceeds to the third reflecting member 300*a*, may be reflected by the center of the third reflecting member 300*a* and may arrive at a third position P3 of the optical member 120. Particularly, the third position P3 may be identical to an area in which light reflected by an end of the concave portion of the third area 20*c* of the cover 200 proceeds to the optical member 120.

For example, when a radius of the optical member 120 exposed at a bottom of the first body 100 is r, the first position P1 may be an area of 0.65 r to 0.75 r of the optical member 120. Also, the second position P2 may be an area of 0.4 r to 0.5 r of the optical member 120. Also, the third position P3 may be an area within a range of 0.1 r of the optical member 120.

Following Table 1 shows light intensity of first, second, and third positions according to the embodiment. Here, the light may be the second light which is emitted by the light source 130*b*, is reflected at least one time by the inner surface of the cover 200, and proceeds to the optical member 120. The intensity of light reflected at least one time by the cover 200 and the third reflecting member 300*a* is illustrated.

As shown in Table 1, in the lighting apparatus according to the embodiment of the present disclosure, the intensity of light which arrives at the third position among the first, second, and third positions is greatest.

TABLE 1

| | First position (P1) | | Second position (P2) | | Third position (P3) | |
|---|---|---|---|---|---|---|
| | First angle (θ1) 70° | Angle between cover and light source 36.28° | Second angle (θ2) 38.18° | Angle between cover and light source 21.39° | Third angle (θ3) 47.95° | Angle between cover and light source 2.73° |
| Intensity of light | 0.325 | 0.899 | 0.672 | 0.838 | 0.636 | 0.899 |
| Sum | 1.224 (100%) | | 1.510 (423.3%) | | 1.535 (125.4%) | |

Generally, the first light may be reduced in intensity when distancing from the light source 130*b*. When the light source 130*b* is provided at the edge of the lighting apparatus like the embodiment of the present disclosure, the intensity of the first light may differ for each of the first, second, and third positions P1, P2, and P3. The intensity of the first light may be strongest at the first position P1 most adjacent to the light source 130*b* and weakest at the third position P3 most distant from the light source 130*b*. Accordingly, when light (the first light) directly incident from the light source 130*b* is added to light (the second light) reflected by the cover 200 and the third reflecting member 300*a*, a deviation of the light intensities at the first, second, and third positions may be reduced.

Figure 30:
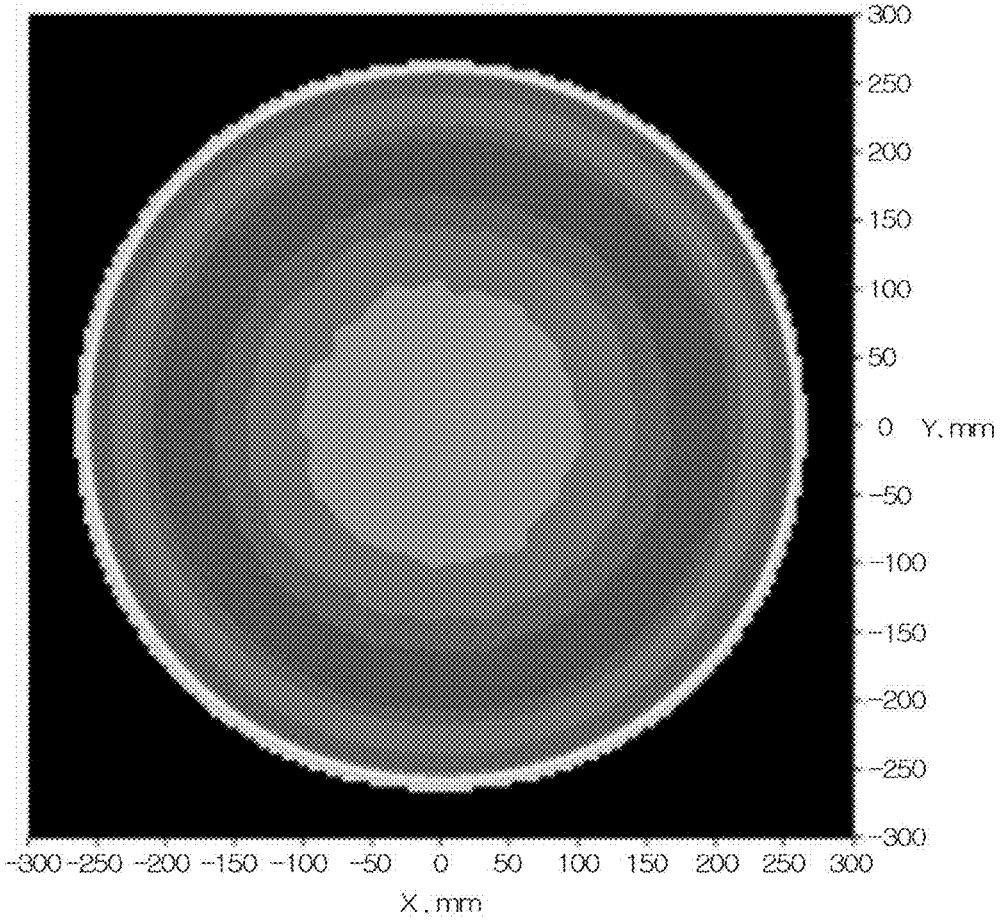
FIG. 30 illustrates light emission of a lighting apparatus according to Table 1.

As shown in FIG. 30, in the lighting apparatus according to Table 1, a difference in light emission between the central portion and the edge on which the light source member is provided may be reduced. Particularly, as shown in Table 2, a difference between brightness of the central portion and maximal brightness may be reduced and accordingly the deviation of the brightness of the lighting apparatus may be reduced. Also, since the brightness of the central portion increases in the lighting apparatus according to the embodiment of the present disclosure, overall efficiency of the lighting apparatus may be improved.

TABLE 2

| | | | |
|---|---|---|---|
| Maximum brightness | 12980.5 | Brightness of central portion/ maximum brightness | 0.839 |
| Average brightness | 11322.5 | Average brightness/ maximum brightness | 0.872 |
| Brightness of central portion | 10895 | Efficiency | 0.73 |

As described above, in the lighting apparatus according to the embodiment of the present disclosure, since the third reflecting member 300*a* which specularly reflects light to the inner surface of the cover 200 is provided, the intensity of light which is reflected by the third reflecting member 300*a* and proceeds to the central portion of the lighting apparatus may increase. Accordingly, the brightness of the central portion of the lighting apparatus increases and brightness uniformity of the lighting apparatus increases.

Meanwhile, to diffuse the light emitted by the light source member 130, the fourth reflecting member 300*b* may be located on the horizontal portion 110*a* of the second body 110. The fourth reflecting member 300*b* may include metal with high reflectance like the third reflecting member 300*a*.

According to the foregoing embodiments, a brightness deviation between a central portion and an edge of a lighting apparatus may be reduced by arranging light sources along an edge of a cover. When an optical member is fixed between first and second ring-shaped bodies with an inner circumferential surface and an outer circumferential surface, a first inner circumferential surface of the first body further extends to an inside of the optical member rather than a second inner circumferential surface of the second body. Since a shadow generated by the first body near the optical member is cut off by the second body, a light emission surface of the optical member exposed below the first body may have the uniform brightness. Accordingly, brightness uniformity of the lighting apparatus increases, thereby improving quality.

A connecting member which electrically connects a power supply member disposed outside the cover with a light source member disposed inside the cover is inserted in a groove formed at an inner surface of the cover and a reflecting member is disposed to cover the groove, thereby removing optical interference caused by the connecting member. A first reflecting member is disposed on the inner surface of the cover, thereby allowing light emitted by the light source member to be reflected by the first reflecting member and proceed to the central portion of the lighting apparatus. Here, the first reflecting member is formed as the form of a film including metal with high reflectance and specularly reflects incident light. Accordingly, the lighting apparatus according to embodiments of the present disclosure may easily control light which proceeds to the central portion of the lighting apparatus by adjusting an angle of the inner surface of the cover on which the first reflecting member is disposed.

A lighting apparatus may include a first body including a first inner circumferential surface and a first outer circumferential surface, a cover located on and fastened to the first body and including an open bottom surface, an optical member provided between the first body and the cover and exposed at the open bottom surface of the cover, and a light source member including a circuit board located between the cover and the optical member along an edge of the cover and at least two light sources mounted on the circuit board to face each other. The cover may include a first reflecting surface convex upward.

A second reflecting surface provided inside the first reflecting surface and convex downward may be included. The first reflecting surface may include a curved surface convex upward from an outer perimeter of a first reflecting member. A curvature radius of the second reflecting surface may be greater than a curvature radius of the first reflecting surface.

The present disclosure may have various modifications and several embodiments, and particular embodiments will be illustrated in the drawings and described. However, it will be understood that the present disclosure is not limited to the particular embodiments and includes all modifications, equivalents, and substitutes included in the concept and scope of the present disclosure.

The terms first, second, etc. may be used for describing various components, but the components will not be limited by the terms. The terms are used only for distinguishing one element from others. For example, without departing from the scope of the present disclosure to be described below, a first component may be referred to as a second component, and similarly, the second component may be referred to as the first component. The term "and/or" includes any and all combinations or one of a plurality of associated listed items.

When it is stated that one component is "connected" to another component, it should be understood that it may be directly connected to the other component but another component may exist therebetween. On the contrary, when it is stated that one component is "directly connected" to another component, it should be understood that no other component exists therebetween.

Terms are used herein only to describe particular embodiments and do not intend to limit the present disclosure. Singular expressions, unless contextually otherwise defined, include plural expressions. Also, throughout the specification, it should be understood that the terms "comprise", "have", etc. are used herein to specify the presence of stated features, numbers, steps, operations, elements, components or combinations thereof but do not preclude the presence or addition of one or more other features, numbers, steps, operations, elements, components, or combinations thereof.

Unless otherwise defined, all terms used herein including technical or scientific terms have the same meanings generally understood by one of ordinary skill in the art. Terms as defined in dictionaries generally used should be understood as having meaning identical to meaning contextually defined in the art and should not be understood as ideally or excessively formal meaning unless definitely defined herein.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A lighting apparatus comprising:

a first body including a first inner circumferential surface and a first outer circumferential surface;

a cover located on and fastened to the first body and including an open bottom surface;

an optical member arranged between the first body and the cover and exposed at the open bottom surface of the cover;

a light emitting module including a circuit board provided between the cover and the optical member along an edge of the cover and at least two light sources mounted on the circuit board to face each other; and a second body disposed between the first body and the cover and comprising a second inner circumferential surface and a second outer circumferential surface, wherein the optical member is disposed between the first body and the second body, a top surface of the optical member is in close contact with the second body, and a bottom surface of the optical member is in close contact with the first body.

2. The lighting apparatus of claim 1, wherein the cover includes a first reflecting surface convex upward.

3. The lighting apparatus of claim 2, including a reflector including a second reflecting surface which is provided inside the first reflecting surface and convex downward.

4. The lighting apparatus of claim 3, wherein the first reflecting surface includes a curved surface convex upward from an outer perimeter of the reflector.

5. The lighting apparatus of claim 3, wherein a curvature radius of the second reflecting surface is greater than a curvature radius of the first reflecting surface.

6. The lighting apparatus of claim 1, wherein a contact area between the first body and the bottom surface of the optical member is larger than a contact area between the second body and the top surface of the optical member.

7. The lighting apparatus of claim 1, wherein a distance between the first inner circumferential surface of the first body and the second inner circumferential surface of the second body is greater than a thickness of the second inner circumferential surface of the second body.

8. The lighting apparatus of claim 1, wherein the first inner circumferential surface of the first body protrudes further into the optical member than the second inner circumferential surface of the second body.

9. The lighting apparatus of claim 1, wherein the first body, the second body, and the cover are coupled with one another using a fastener, the lighting apparatus including a sealing member provided on the cover to surround the fastener.

10. The lighting apparatus of claim 1, including:

a power supply provided on the cover;

at least one connector which passes through the cover, is inserted in a first groove formed at an inner surface of the cover, extends to an edge of the cover, and electrically connects the power supply with the light emitting module; and a reflector formed at the inner surface of the cover to cover the first groove.

11. The lighting apparatus of claim 10, wherein the cover includes a second groove which protrudes from an edge to the outside of the cover and accommodates the connector.

12. The lighting apparatus of claim 10, wherein the connector includes:

a first wire electrically connected to the light emitting module;

a second wire electrically connected to the power supply; and a fastening portion which electrically connects the first wire with the second wire.

13. The lighting apparatus of claim 10, wherein the reflector is completely inserted in the first groove.

14. The lighting apparatus of claim 1, wherein the cover includes:

a first area which extends from a second area to an edge of the first body;

the second area including an inner surface on which a reflector is provided; and a third area which extends from the second area to an area overlapping a center of the optical member.

15. The lighting apparatus of claim 14, wherein the reflector specularly reflects light incident on the reflector, and wherein the cover diffusely reflects light incident on the cover.

16. The lighting apparatus of claim 14, wherein the reflector includes a first end in contact with the first area, a second end in contact with the third area, and a center between the first end and the second end, and wherein a first angle between an imaginary line which connects the first end of the reflector with a center of a light emission surface of the light source and a top surface of the optical member is greater than a second angle between an imaginary line which connects the second end of the reflector with the center of the light emission surface of the light source and the top surface of the optical member.

17. The lighting apparatus of claim 16, wherein the first angle is 70° to 75°, and the second angle is 35° to 40°.

18. The lighting apparatus of claim 16, wherein a third angle between an imaginary line which connects the center of the reflector with the center of the light emission surface of the light source and the top surface of the optical member is 45° to 50°.

19. A lighting apparatus comprising:

a first body including a first inner circumferential surface and a first outer circumferential surface;

a cover located on and fastened to the first body and including an open bottom surface;

an optical member arranged between the first body and the cover and exposed at the open bottom surface of the cover;

a light emitting module including a circuit board provided between the cover and the optical member along an edge of the cover and at least two light sources mounted on the circuit board to face each other;

a power supply provided on the cover;

at least one connector which passes through the cover, is inserted in a first groove formed at an inner surface of the cover, extends to an edge of the cover, and electrically connects the power supply with the light emitting module; and a reflector formed at the inner surface of the cover to cover the first groove.

20. A lighting apparatus comprising:

a first body including a first inner circumferential surface and a first outer circumferential surface;

a cover located on and fastened to the first body and including an open bottom surface;

an optical member arranged between the first body and the cover and exposed at the open bottom surface of the cover; and a light emitting module including a circuit board provided between the cover and the optical member along an edge of the cover and at least two light sources mounted on the circuit board to face each other, wherein the cover includes:

a first area which extends from a second area to an edge of the first body;

the second area including an inner surface on which a reflector is provided; and a third area which extends from the second area to an area overlapping a center of the optical member, and wherein the reflector includes a first end in contact with the first area, a second end in contact with the third area, and a center between the first end and the second end, and wherein a first angle between an imaginary line which connects the first end of the reflector with a center of a light emission surface of the light source and a top surface of the optical member is greater than a second angle between an imaginary line which connects the second end of the reflector with the center of the light emission surface of the light source and the top surface of the optical member.

* * * * *